US011639683B2

(12) United States Patent
Morgan et al.

(10) Patent No.: US 11,639,683 B2
(45) **Date of Patent: *May 2, 2023**

(54) SPLIT CYCLE ENGINE

(71) Applicant: Dolphin N2 Limited, Shoreham-By-Sea (GB)

(72) Inventors: Robert Morgan, Shoreham By Sea (GB); James Eatwell, Sussex (GB); Andrew Atkins, Shoreham-By-Sea (GB); Adam Gurr, Sussex (GB)

(73) Assignee: Dolphin N2 Limited

( * ) Notice: Subject to any disclaimer, the term of this patent is extended or adjusted under 35 U.S.C. 154(b) by 0 days.

This patent is subject to a terminal disclaimer.

(21) Appl. No.: 17/843,271

(22) Filed: Jun. 17, 2022

(65) Prior Publication Data

US 2022/0316386 A1 Oct. 6, 2022

Related U.S. Application Data

(63) Continuation of application No. 17/356,673, filed on Jun. 24, 2021, now Pat. No. 11,391,198, which is a (Continued)

(30) Foreign Application Priority Data

Dec. 23, 2016 (GB) ..... 1622114
Apr. 28, 2017 (GB) ..... 1706792

(51) Int. Cl.
*F02D 41/06* (2006.01)
*F02B 33/22* (2006.01)
(Continued)

(52) U.S. Cl.
CPC ..... *F02B 33/22* (2013.01); *F01N 3/2006* (2013.01); *F01N 5/02* (2013.01); *F01N 11/002* (2013.01);
(Continued)

(58) Field of Classification Search
CPC ..... F02D 41/064; F02D 41/0025; F02D 13/0207; F02D 19/12; F02D 35/023;
(Continued)

(56) References Cited

U.S. PATENT DOCUMENTS 4,224,798 A 9/1980 Brinkerhoff
8,590,497 B2 11/2013 Meldolesi et al.
(Continued)

FOREIGN PATENT DOCUMENTS

CN 102207028 A 10/2011
CN 102597455 A 7/2012
(Continued)

OTHER PUBLICATIONS

Chinese Search Report for Application No. 201780085449.1 dated Jan. 28, 2021, 3 pages.
(Continued)

*Primary Examiner* — Hai H Huynh
(74) *Attorney, Agent, or Firm* — Lerner David LLP

(57) ABSTRACT

A split cycle internal combustion engine includes a combustion cylinder accommodating a combustion piston and a compression cylinder accommodating a compression piston. The engine also includes a controller arranged to receive an indication of a parameter associated with the combustion cylinder and/or a fluid associated therewith and to control an exhaust valve of the combustion cylinder in dependence on the indicated parameter to cause the exhaust valve to close during the return stroke of the combustion piston, before the combustion piston has reached its top dead centre position (TDC), when the indicated parameter is less than a target value for the parameter; and close on completion of the return stroke of the combustion piston, as the combustion
(Continued)

piston reaches its top dead centre position (TDC), when the indicated parameter is equal to or greater than the target value for the parameter.

20 Claims, 15 Drawing Sheets

Related U.S. Application Data continuation of application No. 16/472,678, filed as application No. PCT/GB2017/053831 on Dec. 20, 2017, now Pat. No. 11,078,829.

(51) Int. Cl.

| | |
|---|---|
| ***F01N 3/20*** | (2006.01) |
| ***F01N 5/02*** | (2006.01) |
| ***F01N 11/00*** | (2006.01) |
| ***F01P 3/22*** | (2006.01) |
| ***F02B 47/04*** | (2006.01) |
| ***F02D 13/02*** | (2006.01) |
| ***F02D 19/12*** | (2006.01) |
| ***F02D 35/02*** | (2006.01) |
| ***F02D 41/00*** | (2006.01) |
| ***F02F 7/00*** | (2006.01) |
| ***F02M 31/04*** | (2006.01) |
| ***F02M 31/08*** | (2006.01) |

(52) U.S. Cl.

CPC ..... *F01P 3/22* (2013.01); *F02B 47/04* (2013.01); *F02D 13/0207* (2013.01); *F02D 19/12* (2013.01); *F02D 35/023* (2013.01); *F02D 35/025* (2013.01); *F02D 41/0025* (2013.01); *F02D 41/064* (2013.01); *F02F 7/0087* (2013.01); *F02M 31/042* (2013.01); *F02M 31/08* (2013.01); *F01P 2003/2214* (2013.01); *F02D 2013/0292* (2013.01)

(58) Field of Classification Search

CPC ..... F02D 35/025; F02D 2013/0292; F02B 33/22; F02B 47/04; F01N 3/2006; F01N 5/02; F01N 11/002; F01P 3/22; F01P 2003/2214; F02F 7/0087; F02M 31/042; F02M 31/08

USPC ... 123/299, 300, 305, 491, 27 GE, 525, 435, 123/543, 557, 68, 70 R, 58.8

See application file for complete search history.

(56) References Cited

U.S. PATENT DOCUMENTS

| | | | |
|---|---|---|---|
| 11,078,829 | B2 | 8/2021 | Morgan et al. |
| 2007/0289562 | A1 | 12/2007 | Zajac et al. |
| 2011/0094462 | A1 | 4/2011 | Durrett et al. |
| 2011/0174267 | A1 | 7/2011 | Surnilla et al. |
| 2011/0220083 | A1 | 9/2011 | Meldolesi et al. |
| 2012/0103314 | A1 | 5/2012 | Jackson et al. |
| 2012/0167566 | A1 | 7/2012 | Gentili et al. |
| 2013/0160726 | A1 | 6/2013 | Zajac |
| 2013/0318938 | A1 | 12/2013 | Coates |
| 2014/0090615 | A1 | 4/2014 | Mistry |
| 2015/0027116 | A1 | 1/2015 | Fischer |
| 2015/0316005 | A1 | 11/2015 | Madison et al. |
| 2015/0377086 | A1 | 12/2015 | Kobayashi et al. |
| 2016/0115876 | A1 | 4/2016 | Hoshi |
| 2016/0356228 | A1 | 12/2016 | Liu et al. |

FOREIGN PATENT DOCUMENTS

| | | | |
|---|---|---|---|
| CN | 102782275 | A | 11/2012 |
| CN | 102852633 | A | 1/2013 |
| CN | 104405498 | A | 3/2015 |
| CN | 105026699 | A | 11/2015 |
| CN | 105264202 | A | 1/2016 |
| CN | 106246370 | A | 12/2016 |
| EP | 0774062 | A1 | 5/1997 |
| EP | 1186752 | A2 | 3/2002 |
| JP | 2001065375 | A | 3/2001 |
| JP | 2007247438 | A | 9/2007 |
| JP | 2012511664 | A | 5/2012 |
| JP | 2013002403 | A | 1/2013 |
| JP | 2013502534 | A | 1/2013 |
| JP | 2013505396 | A | 2/2013 |
| JP | 2014511976 | A | 5/2014 |
| WO | 9412785 | A1 | 6/1994 |
| WO | 2006096850 | A2 | 9/2006 |
| WO | 2010067080 | A1 | 6/2010 |
| WO | 2015013696 | A1 | 1/2015 |
| WO | 2016016664 | A1 | 2/2016 |
| WO | 2016120598 | A1 | 8/2016 |

OTHER PUBLICATIONS

European Search Report for Application No. EP17829004 dated Feb. 22, 2021, 4 pages.

International Search Report from Application No. PCT/GB2017/053831 dated May 28, 2018, 6 pages.

Search and Examination Report for Application No. GB 1622114.5 dated Apr. 19, 2017, 6 pages.

Search and Examination Report for Application No. GB 1706792.7 dated Aug. 7, 2017, 7 pages.

Search and Examination Report for Application No. GB 1709012.7 dated Jul. 6, 2017, 6 pages.

Written Opinion for Application No. PCT/GB2017/053831 dated May 28, 2018, 9 pages.

Figure 5c

528

| Temperature increment | Value | Exhaust valve closure position |
|---|---|---|
| $T_{target}$ | Target combustion temperature, e.g 700°C | TDC |
| $T_x$ | E.g. 550°C | TDC - x°<br>E.g. 40° |
| $T_y$ | E.g. 400°C | TDC - y°<br>E.g. 80° |
| $T_z$ | E.g. 250°C | TDC - z°<br>E.g. 120° |

SPLIT CYCLE ENGINE

CROSS-REFERENCE TO RELATED APPLICATIONS

The present application is a continuation of U.S. application Ser. No. 17/356,673, filed Jun. 24, 2021, which is a continuation of U.S. application Ser. No. 16/472,678, filed Jun. 21, 2019, which is a national phase entry under 35 U.S.C. § 371 of International Application No. PCT/GB2017/053831, filed Dec. 20, 2017, published in English, which claims priority from Great Britain Patent Application No. 1622114.5, filed Dec. 23, 2016, and from Great Britain Patent Application No. 1706792.7, filed Apr. 28, 2017, the disclosures of which are incorporated by reference herein.

FIELD OF INVENTION

The present disclosure relates to a split cycle internal combustion engine and method of operating the same.

BACKGROUND

In a split cycle internal combustion engine, a working fluid comprising air is compressed in a first, compression, cylinder and provided to a second, combustion, cylinder, where fuel is injected and the mixture of the fuel and the high pressure fluid combusts to produce drive. Thermodynamic benefits may be derived from separating the compression and the expansion/combustion processes in this manner. WO 2010/067080 describes a split cycle engine and associated thermodynamic advantages.

In a split cycle engine, further thermodynamic benefits may be achieved by injecting a cryogenic fluid into the compression cylinder during the compression stroke. Such a system and method is described in WO 2016/016664.

In particular in engines in which a cryogen is used, a recuperator may be provided, having a first fluid path carrying compressed fluid from the compression cylinder to the expansion cylinder, and a second fluid path carrying exhaust gases from an outlet of the combustion cylinder, in order to heat the compressed fluid on its way to the combustion cylinder. This may help to ensure that the compressed fluid arriving at the combustion cylinder is sufficiently hot that combustion may occur when the fuel is injected.

SUMMARY OF INVENTION

The inventor in the present case has appreciated that difficulties in achieving efficient combustion may be encountered during start-up of the engine ("cold start"), when there is little or no exhaust heat in the recuperator, leading to the compressed fluid arriving at the combustion cylinder at a sub-optimal temperature for combustion.

Embodiments described herein address these difficulties.

The invention is set out in the claims appended hereto.

In the following description, the term "cryogenic" fluid or liquid is used to refer to a fluid which has been condensed into its liquid phase via a refrigeration process.

Embodiments described herein relate to a split cycle engine in which a cryogenic fluid is injected during the compression stroke. In other examples, the methods described herein could be implemented without the injection of a cryogen. Additionally, other fluids, water as an example, may be added to the recuperator to control terminal temperature at the exit from the recuperator.

As described herein, the split cycle engine has a controller which is arranged to receive an indication of a parameter associated with the combustion cylinder and/or a fluid associated therewith and to control a feature of the engine in dependence on the indicated parameter.

The parameter may be one or more of a temperature, pressure and oxygen concentration, therefore an indication of a parameter may comprise one or more of temperature data, pressure data and oxygen concentration data.

The controller may receive temperature and pressure data, temperature and oxygen concentration data, pressure and oxygen concentration data or temperature, pressure and oxygen concentration data and use this date to control one or more of the cryogen injection, exhaust valve timing and recuperator water injection, individually or in combination.

In the case where the parameter is a temperature, the indicated temperature could be at least one of a temperature inside the combustion cylinder, a temperature inside the recuperator of the engine, in particular a surface of the recuperator which is coated with a catalyst, a temperature of the compressed fluid in the recuperator, a temperature of the compressed fluid at the inlet of the combustion cylinder or a temperature of the exhaust gas.

In the case where the parameter is a pressure, the indicated pressure could be at least one of a pressure inside the combustion cylinder, a pressure inside the recuperator of the engine, a pressure of the compressed fluid in the recuperator, a pressure of the compressed fluid at the inlet of the combustion cylinder or a pressure of the exhaust gas.

In the case where the parameter is an oxygen concentration, the indicated oxygen concentration could be at least one of an oxygen concentration inside the combustion cylinder, an oxygen concentration inside the recuperator of the engine, an oxygen concentration of the compressed fluid in the recuperator, an oxygen concentration of the compressed fluid at the inlet of the combustion cylinder or an oxygen concentration of the exhaust gas.

The feature of the engine which is controlled may be one or more of the timing of closure of the exhaust valve, the quantity or rate of cryogen injection during the compression stroke and rate, quantity or timing of fuel injection into the combustion cylinder.

In embodiments, the feature of the engine is controlled based on a comparison between the indication of the parameter and a target value for the parameter.

In embodiments, the feature of the engine is controlled based on a difference between the indication of the parameter and a target value for the parameter.

In embodiments, the controller is arranged to receive an indication of a temperature of the compressed fluid at the inlet of the combustion cylinder and to control the closure of the exhaust valve of the combustion cylinder based on a comparison between the indicated temperature and a target temperature for the compressed fluid at the combustion cylinder inlet. The target temperature may be defined based on a desired temperature for combustion in the cylinder. As described herein, the controller is arranged to cause the exhaust valve to close during the return stroke of the combustion piston (108, 128), before the combustion piston has reached its top dead centre position (TDC), when the indicated temperature is less than a temperature; and to close on completion of the return stroke of the combustion piston, as the combustion piston reaches its top dead centre position (TDC), when the indicated temperature is equal to or greater than the target temperature.

Closing the exhaust valve before the combustion piston has reached its top dead centre position (TDC), when the indicated temperature is less than a temperature, may be described as a "cold start" mode of operation. This corresponds to the indicated temperature being sub-optimal for combustion, which may be due to the lack of heat available for collection in the recuperator. By closing the exhaust valve before the combustion piston reaches TDC, a portion of the hot exhaust gases of combustion may be retained inside the combustion cylinder and compressed to raise the temperature of the cylinder to assist combustion on the next engine cycle.

Closing the exhaust on completion of the return stroke of the combustion piston, as the combustion piston reaches its top dead centre position (TDC), may be described as a "normal mode" of operation, which corresponds to the indicated temperature being acceptable for combustion. This condition would usually be expected to be reached after the recuperator, and thereby the temperature of the compressed fluid supplied to the combustion cylinder inlet, has warmed up as hot exhaust gases flow through the recuperator. The exhaust valve may, in this condition, be closed as the combustion piston completes its return stroke, expelling all exhaust gases from the combustion cylinder and into the recuperator pathway.

In other examples, the valve timing control is based on the measurement of a pressure and/or an oxygen concentration, optionally in addition to a temperature measurement.

In embodiments, the controller is arranged to receive an indication of a temperature of the compressed fluid at the inlet of the combustion cylinder and to control the amount of cryogenic fluid provided to the compression cylinder during the compression stroke. This reduces the limitation on the temperature rise of the compressed fluid during "cold" cycles in which there is insufficient heat in the recuperator to raise the compressed fluid to a target combustion temperature at the combustion cylinder inlet.

The control may be based on a comparison between the indicated temperature and a target temperature for the compressed fluid at the combustion cylinder inlet. The target temperature may be defined based on a desired temperature for combustion in the cylinder. As described herein, the controller may be arranged to control the quantity of cryogenic fluid injected into the compression cylinder such that a "normal mode" quantity of cryogenic liquid is provided to the compression cylinder when the indicated temperature is equal to or greater than a target temperature, and a "cold mode" quantity of cryogenic liquid is provided to the compression cylinder when the indicated temperature is less than the target temperature, wherein the "cold mode" quantity is less than the "normal mode" quantity.

The "normal mode" quantity of cryogen will generally be understood to be the rate and quantity of cryogen injection such that the cryogenic liquid vaporises into its gaseous phase during the compression stroke of the compression piston, such that a rise in temperature caused by the compression stroke is limited to approximately zero by the absorption of heat by the cryogenic liquid. This may allow more efficient compression. This may also allow a maximal amount of heat to be recuperated from exhaust gases.

When the indicated temperature is greater than a target temperature for "normal mode" operation, a "hot mode" of operation may be enabled. In this mode, the amount of cryogenic liquid added may be optimised based on the temperature at the inlet, so under high load conditions when more heat is available, temperature is lower at the end of compression than before performing compression work. The "hot mode" quantity of cryogen will be understood as being a higher quantity and/or rate of cryogen injection per compression stroke than the "normal mode" quantity, such that the temperature of the fluid within the compression cylinder is allowed to be controlled within safe limits. For additional temperature control and hardware protection, water could be added to the recuperator under high load conditions.

The "cold mode" quantity of cryogen will be understood as being a lower quantity and/or rate of cryogen injection per compression stroke than the "normal mode" quantity, such that the temperature of the fluid within the compression cylinder is allowed to rise as a result of the compression. This allows the compressed fluid to exit the compression cylinder in a hotter state, to compensate for the lack of heat available in the recuperator.

In other examples, the cryogen injection control is based on the measurement of a pressure and/or an oxygen concentration, optionally in addition to a temperature measurement.

In other examples, the exhaust valve timing and cryogen injection are both controlled based on one or more measured engine parameters.

BRIEF DESCRIPTION OF THE FIGURES

Embodiments of the present invention will now be described, by way of example, with reference to the accompanying drawings.

FIG. 5*c* shows a look-up table for use in controlling the exhaust valve.

DETAILED DESCRIPTION OF THE FIGURES

Figure 1:
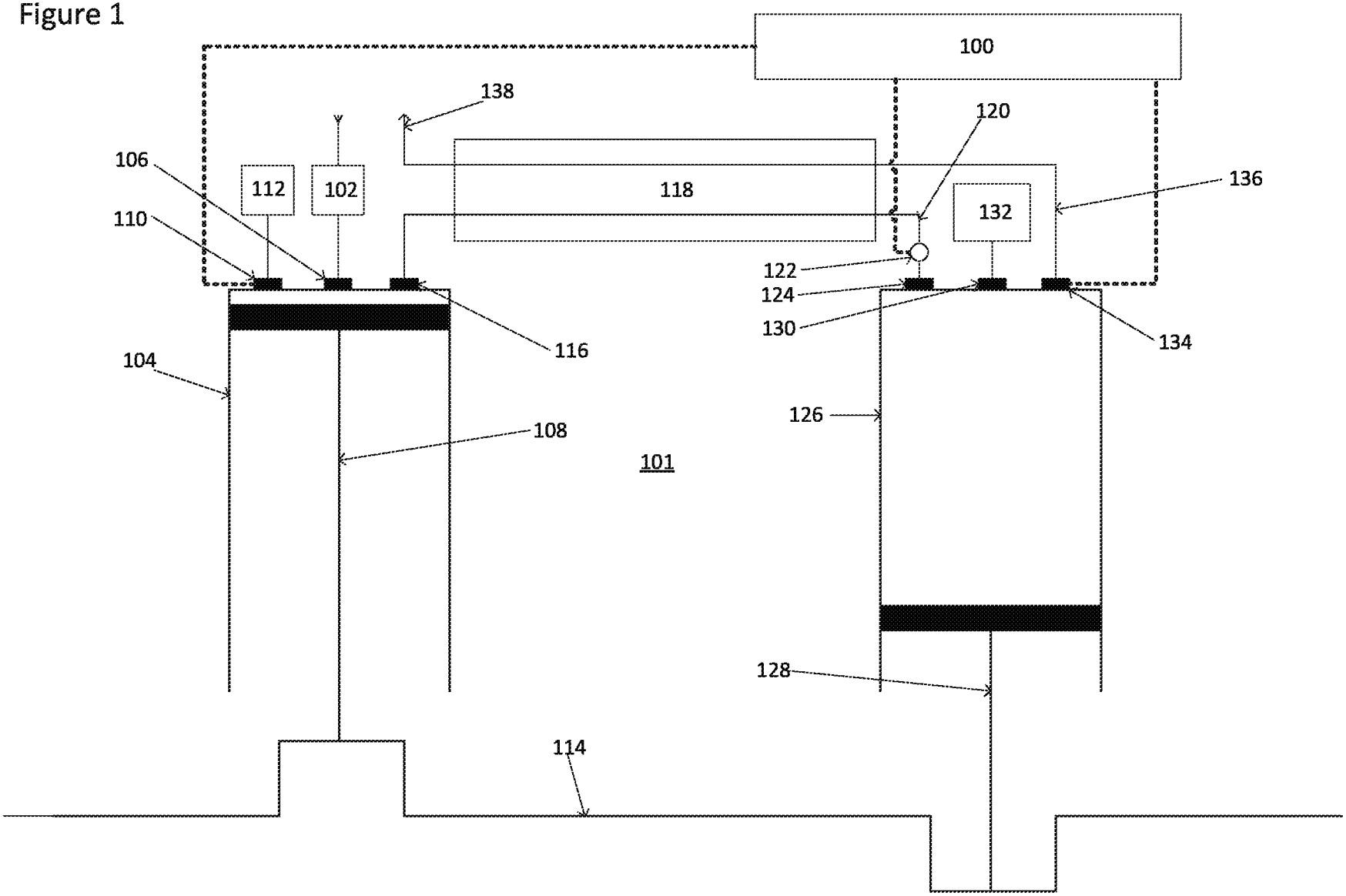
FIG. 1 shows a schematic diagram of a split cycle internal combustion engine.

FIG. 1 shows a schematic diagram of a split cycle internal combustion engine 101. As illustrated, the engine comprises a compression cylinder 104 and a combustion cylinder 126, each cylinder having an associated piston configured to reciprocate within it. As the skilled person will appreciate, multiple similar compression cylinders and combustion cylinders may be present. The compression cylinder 104 comprises a cryogen inlet valve 110 that is connected to a cryogen reservoir 112. The compression cylinder 104 has a fluid inlet valve 106 connected to a turbo charger 102 to receive a compressed air supply and a fluid outlet valve 116. A fluid inlet valve 124 of the combustion cylinder 126 is coupled to the fluid outlet valve 116 to receive compressed fluid from the compression cylinder 104. The combustion cylinder also has a fuel inlet valve 130 coupled to a fuel source 132 and an exhaust valve 134.

Along the path 120 between the compression cylinder fluid outlet valve 116 and the combustion cylinder fluid inlet valve 124, compressed fluid passes through a recuperator 118. This recuperator 118 is heated by exhaust gases from the combustion cylinder exhaust valve 134 passing along an exhaust pathway 136 to an exhaust outlet 138.

The split cycle engine 101 comprises a controller 100. This controller 100 is connected to at least one sensor 122. In examples, at least one sensor 122 could be a temperature sensor, a pressure sensor, an oxygen concentration sensor or any combination thereof. In the illustrated example, a temperature sensor 122 is disposed near the combustion cylinder 126 fluid intake, at a point along the path 120 of the compressed fluid between the recuperator 118 and the combustion cylinder fluid intake valve 124. This sensor 122 is operable to sense the temperature of the compressed fluid and report sensed temperature data back to the controller 100. The controller 100 is arranged to receive this temperature data and control the timing of the exhaust valve 134 on the combustion cylinder 126 based at least in part on the received temperature data. The controller 100 may also be operable to adjust the operation of the cryogen inlet valve 110 to control the amount of cryogen that is injected into the compression cylinder 104.

After combustion occurs in the combustion cylinder 126, the exhaust gas leaves the combustion cylinder 126 via the exhaust valve 134 and travels along exhaust pathway 136 coming into thermal communication with the recuperator 118 to heat compressed fluid travelling along the pathway 120 between the compression cylinder outlet valve 116 and the combustion cylinder inlet valve 124.

The above mentioned sensor or sensors can be located in a multitude of places. In particular, one or more sensors may be placed near the inlet valve 124 on the combustion cylinder as shown in FIG. 1, in the recuperator 118 or near the compression cylinder outlet valve 116.

Figure 2A:
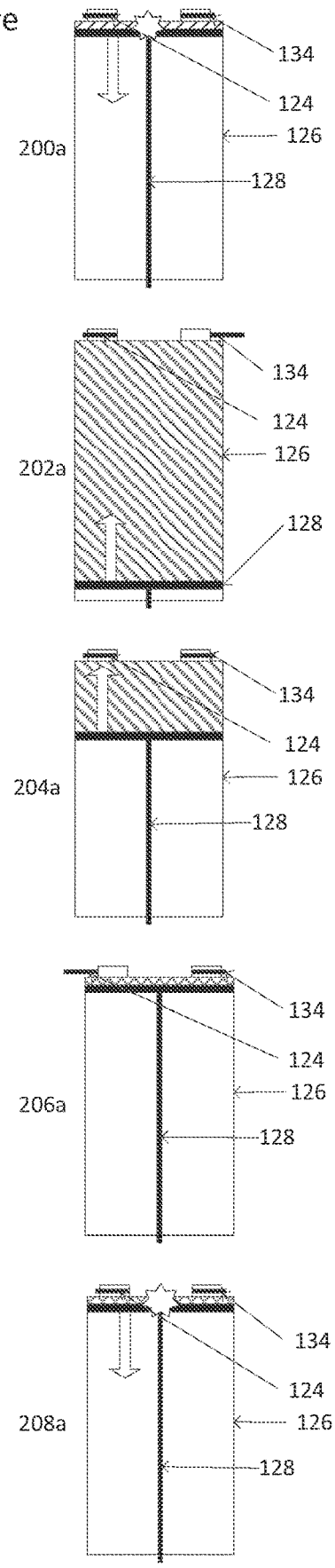
FIG. 2*a* shows stages in the operation of a combustion cylinder of the split cycle engine during a cold start mode.
Figure 2B:
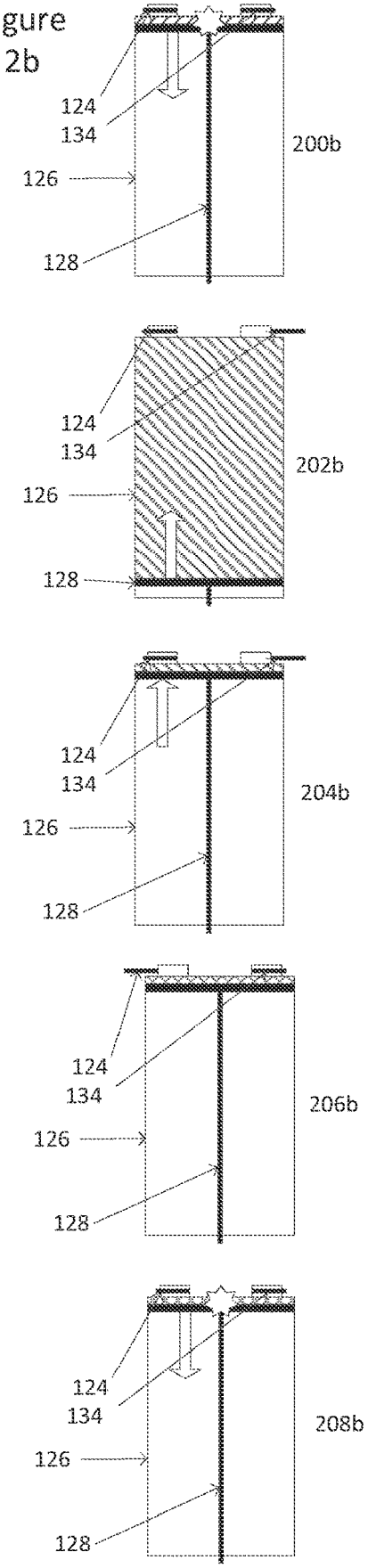
FIG. 2*b* shows stages in the operation of the combustion cylinder during a normal running mode.

FIG. 2*a* shows schematically a process of controlling the combustion cylinder during a cold start mode of operation, including stages 200*a*, 202*a*, 204*a*, 206*a* and 208*a* by comparison to FIG. 2*b* which shows stages 200*b*, 202*b*, 204*b*, 206*b* and 208*b* of a normal running mode. At stage 200*a* the compressed fluid-fuel mixture is igniting as the combustion piston 128 is at TDC. Depending on the type of fuel of the engine, this ignition could be initiated by a spark plug or auto-ignition. The increased pressure due to the released energy from the fuel combustion drives the combustion piston towards bottom dead centre (BDC), further driving the crankshaft 114. Once the piston reaches BDC the combusted mixture has expanded to fill the combustion cylinder 126 and the exhaust valve 134 is opened (stage 202*a*). The combustion piston then proceeds towards TDC, expelling the exhaust gases out the exhaust valve 134.

In the cold start mode, the exhaust valve 134 is closed before the combustion piston reaches TDC. This is shown at stage 204*a*, where the exhaust valve 134 is closed when the piston is about 65% of the way from BDC to TDC. The remaining exhaust gas is then compressed as the piston reaches TDC and, as shown at stage 206*a*, the inlet valve is opened to allow the compressed fluid into the combustion cylinder 126. The inlet valve 124 is closed and the injected fuel is ignited (stage 208*a*), starting the cycle over again. The exhaust gas left in the combustion cylinder 126 when the exhaust valve 134 is closed will heat up the compressed fluid. This may lead to an increase in efficiency of the engine by offsetting the lack of heat in the engine, and in particular the recuperator 188. The compressed fluid therefore arrives at the combustion cylinder inlet at a sufficiently high temperature, having recuperated heat from the exhaust gases.

This is in contrast to the normal running mode in FIG. 2*b*. In this cycle, stage 200*b*, 202*b*, 206*b* and 208*b* correspond to 200*a*, 202*a*, 206*a* and 208*a* respectively. The difference between the cold start mode and the normal running mode is highlighted at stage 204*b*. Here, the exhaust valve 134 is open until the combustion piston reaches TDC such that most of the exhaust gas is expelled from the cylinder. In this mode, the engine is running "normally" whereby all, or most, of the exhaust gases are expelled into the recuperator.

Figure 3:
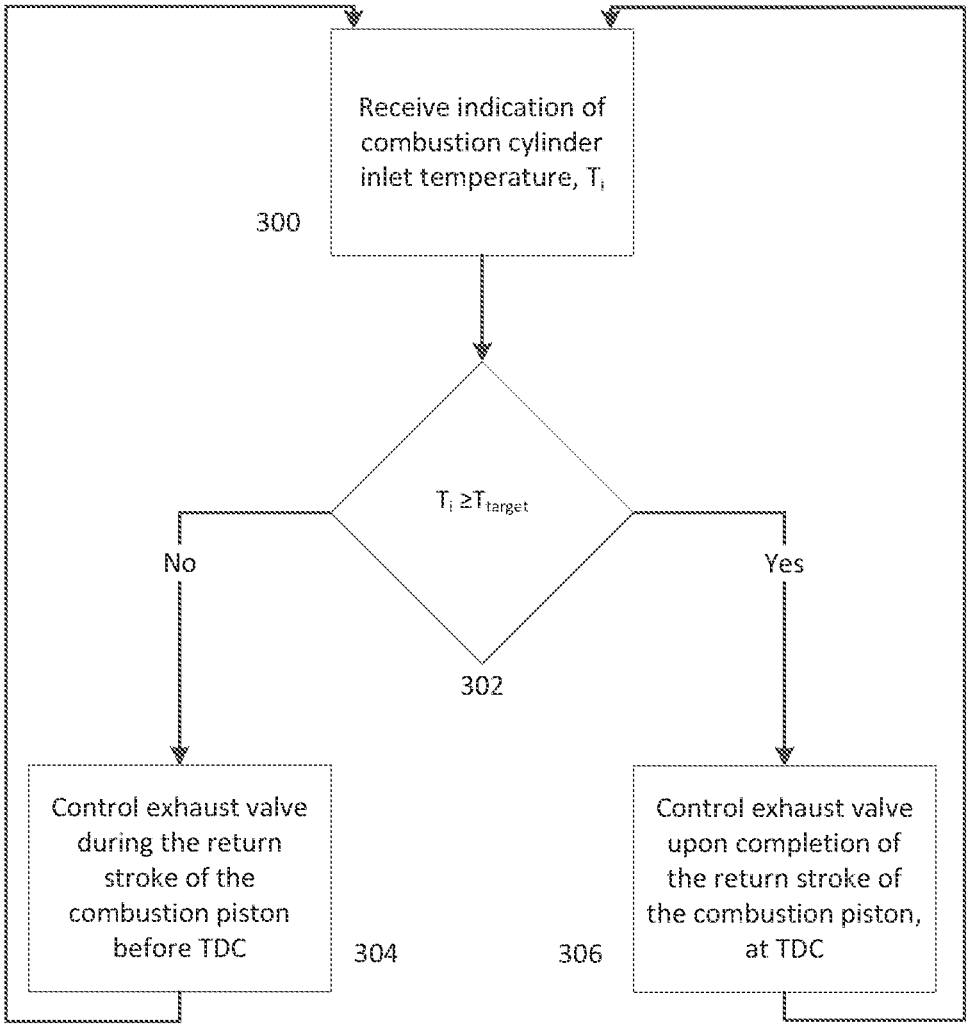
FIG. 3 shows a decision chart for controlling an exhaust valve of the combustion cylinder.

FIG. 3 shows a flow diagram for a control process that occurs at the controller 100. The controller 100 receives an indication of the combustion cylinder 126 inlet temperature from a temperature sensor located near the combustion cylinder 126 inlet. This temperature, $T_i$, is then compared against a target temperature, $T_{target}$. In this example, $T_{target}$ is a desired temperature for the compressed fluid at the combustion cylinder inlet 124, such as will allow efficient combustion when the fuel is injected.

If $T_i$ is not greater than or equal to $T_{target}$ (corresponding to a "normal running" mode), the controller controls the exhaust valve 134 timing so that the exhaust valve 134 is closed before the combustion piston reaches TDC, causing a portion of the exhaust gas to be trapped in the combustion cylinder 126.

If $T_i$ is greater than or equal to $T_{target}$ (corresponding to a "cold start" mode), controller controls the exhaust valve 134 operation timing so that the exhaust valve 134 is closed at the point at which the combustion piston is at TDC, at which point, most of the exhaust gas will have been expelled as the compressed gas is sufficiently heated by the recuperator.

Figure 4:
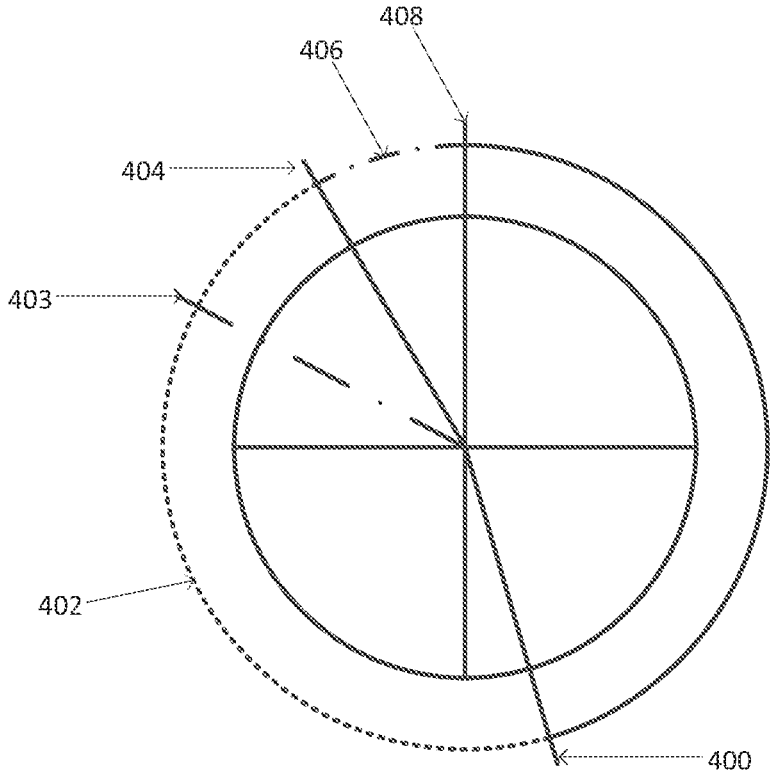
FIG. 4 represents relative valve timings in the combustion cylinder.

FIG. 4 shows a representation of the relative timings (as phase angles/crank angles) of the opening and closing operations of the combustion cylinder valves in a normal running mode.

The longer radial lines (400, 404 and 408) represent valve control events. A full 360° clockwise traverse of the circle represents a full piston cycle.

At phase angle 408, all of the valves of the combustion cylinder 126 are closed and a combustible mix is present in the combustion cylinder. The combustion piston is at TDC. The mixture is then ignited and the piston moves towards BDC.

Moving clockwise, phase angle 400 represents the opening of the exhaust valve (EVO), which occurs a short amount of time before the combustion piston reaches BDC. This position can be described by the amount of degrees clockwise from the vertical line, corresponding, to the phase angle offset of the combustion piston from TDC. For example EVO may occur at 170° as in the example shown in FIG. 4.

The exhaust valve 134 is open until phase angle 404, approximately 340° in the example shown, at which point the exhaust valve closing (EVC) event, occurs. This is just before the fluid intake valve opening event (IVO) which will occur immediately after EVC. In FIG. 4, the line for this event is not separately shown as the time between this event and the exhaust valve closing (EVC) event is too short to show clearly. The inlet valve is then open until the full cycle is completed at 360° at which point the inlet valve is closed (IVC), the combustion piston is at TDC and the combustible mixture is ignited at 0°/360° and the cycle is then repeated.

In a cold start mode, the phase angle of the EVC/IVO changes as the time the exhaust valve 134 is open for is reduced. This means EVC/IVO occurs at a smaller phase angle offset. This phase angle offset can be described as a number of degrees before TDC (0°). An example is shown as a dashed line 403 in FIG. 4, where the EVO/IVO occurs approximately 60° before TDC.

Figure 5A:
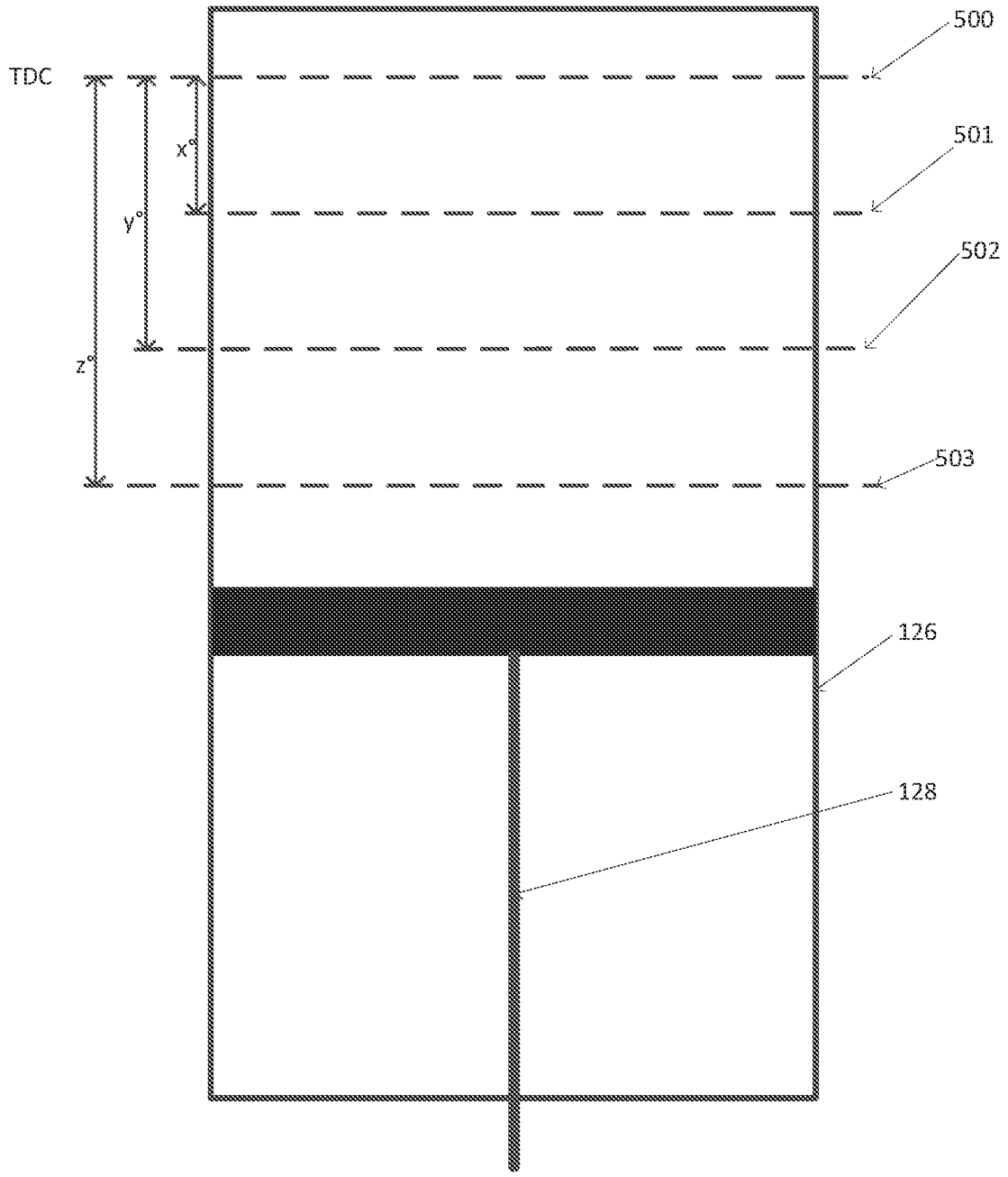
FIG. 5*a* shows examples of exhaust valve closure positions illustrated by positions of the combustion piston within the combustion cylinder.

FIG. 5*a* shows a combustion piston 128 within the combustion cylinder 126. Various possible combustion piston 128 positions, indicated by dashed lines, corresponding to early closure positions of the exhaust valve 134 are shown.

TDC is indicated by the uppermost dashed line 500. This is the piston position that corresponds to the "normal closure" position of the exhaust valve, wherein the indicated temperature is found to be sufficiently high and all of the exhaust gases are expelled from the combustion cylinder during the course of a full return stroke of the combustion piston (128). The piston positions for various early exhaust valve closure positions, corresponding to various cold start modes of operation, are indicated by further dashed lines (501, 502 and 503).

A first early exhaust valve closure position is represented by line 501, which corresponds to the combustion piston being at a phase angle of x° before TDC. (In this example, the position marked x° represents a position (360−x)° clockwise around the circle described in reference to FIG. 4.)

A second early exhaust valve closure position is represented by line (502), which corresponds to the combustion piston being at a phase angle of y° before TDC, in which y° is a greater angular from TDC offset than x°. This position corresponds to an earlier valve closure position than the first closure position.

A third early exhaust valve closure position is represented by line 503, which corresponds to the combustion piston being at a phase angle of z° before TDC. TDC, in which z° is a greater angular from TDC offset than y°. This position corresponds to an earlier exhaust valve closure position than the first and second exhaust valve closure positions. In this example, the third early exhaust valve closure position represents the maximum early exhaust valve closure position. This is the earliest that the exhaust valve 134 can close and leaves the most exhaust gas in the combustion cylinder 126 which will allow the compressed fluid, which is taken into the cylinder when the inlet valve is opened, to be heated as much as possible. Retention of any greater quantity of exhaust gas, may however have a deleterious effect.

The choice of which position the exhaust valve 134 closes at varies based on the data that the controller 100 receives from any attached sensors. As discussed above, the point at which the exhaust valve 134 closes can vary depending on temperature data from a temperature sensor. When the temperature sensor indicates a temperature that is above or equal to the target temperature, a normal running mode is used and the exhaust valve 134 closes at TDC. This target temperature could be a target temperature for combustion such that the fluid fuel mixture is at this temperature before ignition.

If the temperature is below $T_{target}$, the exhaust valve 134 can be closed at a position (phase angle) z°, y° or x°, for example, before TDC. The selection of the appropriate early exhaust valve closure point (cold start mode) may be determined by reference to a look-up table, such as that shown in FIG. 5*c*, in which different early closure positions are mapped onto different indicated temperature ranges. In general, upon start-up, when $T_i$ is generally at its lowest, the controller 100 may select the maximum early exhaust valve closure position z° 503, to retain the maximum acceptable quantity of exhaust gas inside the combustion cylinder for maximum heating effect. On a subsequent engine cycle when $T_i$ has increased, but is still below Tt, the controller may select an intermediate early exhaust valve closure position such as y° 502. Again on a subsequent cycle when $T_i$ has increased further but it still below $T_{target}$, the controller 100 may select another early exhaust valve closure position, x° 501, which is closer to TDC.

On a later engine cycle when $T_i$ matches or exceeds $T_{target}$, the controller may select the normal closure position, with the piston at TDC, in which all of the exhaust gases are expelled on completion of the return stroke, as no additional heating is required.

Figure 5B:
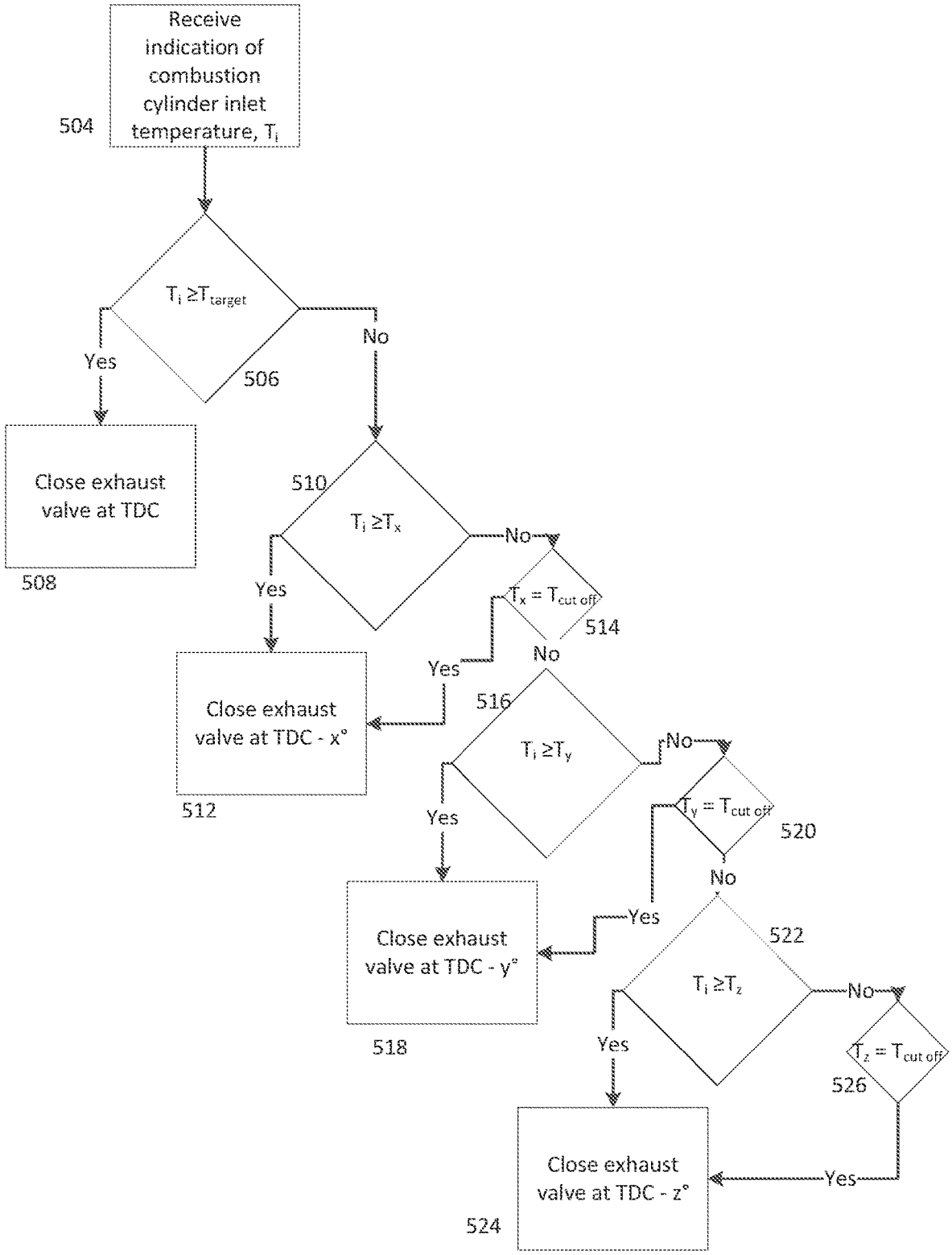
FIG. 5*b* shows a controller decision process for controlling the exhaust valve.

The controller's decision process is shown by the flowchart in FIG. 5*b*. The controller 100 receives temperature data from the temperature sensor. The indicated temperature, $T_i$, is compared to the target temperature, $T_{target}$. If the indicated temperature, $T_i$, is greater than or equal to $T_{target}$, the controller 100 will control the exhaust valve 134 to close when the combustion piston reaches TDC. If $T_i$ is less than $T_{target}$ then the controller 100 will compare $T_i$ to a second temperature, $T_x$, which is less than the target temperature. If $T_i$ is larger than $T_x$ then the controller 100 controls the exhaust valve 134 to close at a phase angle of x° before the combustion piston reaches TDC, as can be seen in FIG. 5*a*. After this comparison the controller 100 checks to see if $T_x$ is the cut off temperature, $T_{cut\ off}$. If these temperatures match, the controller 100 controls the exhaust valve to close at the corresponding position as this is the cut off position, or "maximum early exhaust valve closure position", for the engine. This decision tree continues in FIG. 5*b* with $T_i$ being compared successively to $T_y$ and $T_z$. Each of these has an associated position, corresponding respectively to the combustion piston being a phase angle of y° and z° before TDC. In examples, there could be additional temperature thresholds ranging from $T_{target}$ to $T_{cut\ off}$. Finally, $T_z$ is equal to the cut off temperature corresponding to the maximum early closure position and therefore the controller 100 controls the exhaust valve 134 to close at a maximum early exhaust valve closure position in which the combustion cylinder is at a phase angle z° before TDC.

The maximum early exhaust valve closure position may be defined as the point at which no greater value would be derived from retaining more exhaust gases within the combustion cylinder, or at which point the negative effects of retaining exhaust gases would outweigh the temperature benefit. This decision process can occur after every cycle of the combustion piston such that the controller 100 can provide an updated early closure position for every piston cycle.

FIG. 5*c* shows a look-up table of these values, with the set temperature points and their corresponding exhaust valve 134 closure positions. This can be stored by the controller 100 in a memory, allowing the target temperature and other threshold temperatures to be recalled from a look up table and compared to the indicated temperature. For example, there could be a situation where z°=120°, y°=80° and x°=40°. In other examples there could be more or fewer intermediate positions between the maximum early closure position and TDC.

In other embodiments, the earlier closure position is calculated based on an algorithm that takes the indicated temperature and/or a target temperature into account. This may be a simple proportional dependence relation or of a more complex form.

Figure 6:
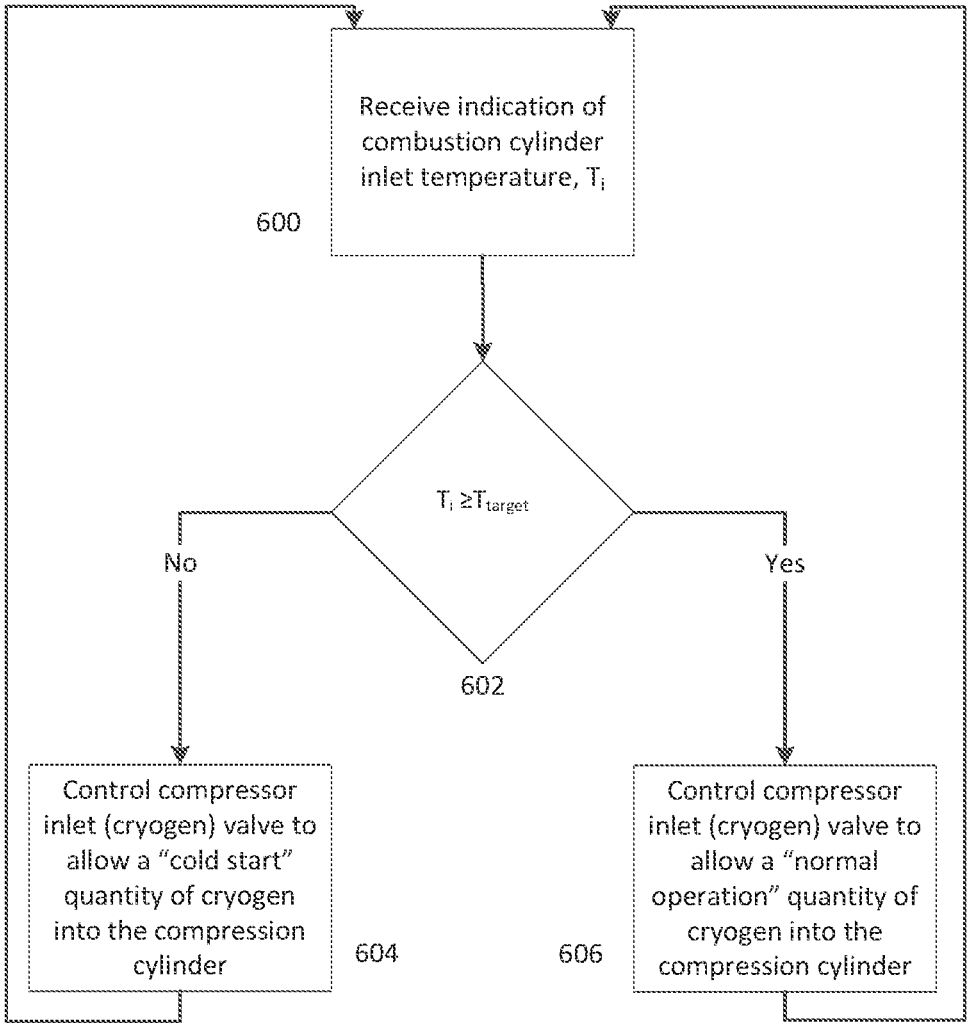
FIG. 6 shows a decision process for controlling a cryogen inlet valve of a compression cylinder of the split cycle engine.

FIG. 6 shows an embodiment in which the amount of cryogen injected into the compression cylinder is controlled in dependence on a temperature indication. Upon receipt of a temperature indication, the controller 100 compares $T_i$ to a target temperature, $T_{target}$. If the indicated temperature is larger, the controller 100 controls the cryogen inlet to the compression cylinder 104 to allow a "normal operation" quantity of cryogen into the compression cylinder 104. The amount may be controlled by the controller that determines the amount of cryogen.

In embodiments, this may use the same temperature data as used by the controller for operating the exhaust valve timing and can be done in addition to valve timing and recuperator water injection. In other examples, the controller may use separate temperature data, collected by a different sensor. Of course, this applies to both pressure and oxygen concentration sensor data and the corresponding sensors in embodiments where this data is collected.

If the indicated temperature is smaller than the target temperature, the controller 100 can control the cryogen inlet to allow a "cold start" quantity of cryogen into the compression cylinder 104. This quantity may be determined by further decision making, such as comparing the indicated temperature to a range of set temperature values, or calculation. In some embodiments no cryogen is injected into the compression cylinder 104 during cold start mode.

The process described above where the sensed parameter is the indicated temperature which is compared with target temperatures may be applied in the circumstance where the sensed parameter is pressure or oxygen concentration. In these cases, the pressures or oxygen concentrations sensor indication would of course be compared to target pressures or oxygen concentrations, as the case may be, enabling the controller 100 to determine an early exhaust closure position for the exhaust valve 134 based on these parameters or indications.

When the indicated temperature is greater than a target temperature for "normal mode" operation, a "hot mode" of operation may be enabled. In this mode, the amount of cryogenic liquid added may be optimised based on the temperature at the inlet, so under high load conditions when more heat is available, temperature is lower at the end of compression than before performing compression work. The "hot mode" quantity of cryogen will be understood as being a higher quantity and/or rate of cryogen injection per compression stroke than the "normal mode" quantity, such that the temperature of the fluid within the compression cylinder is allowed to be controlled within safe limits. For additional temperature control and hardware protection, water could be added to the recuperator under high load conditions.

Figure 7:
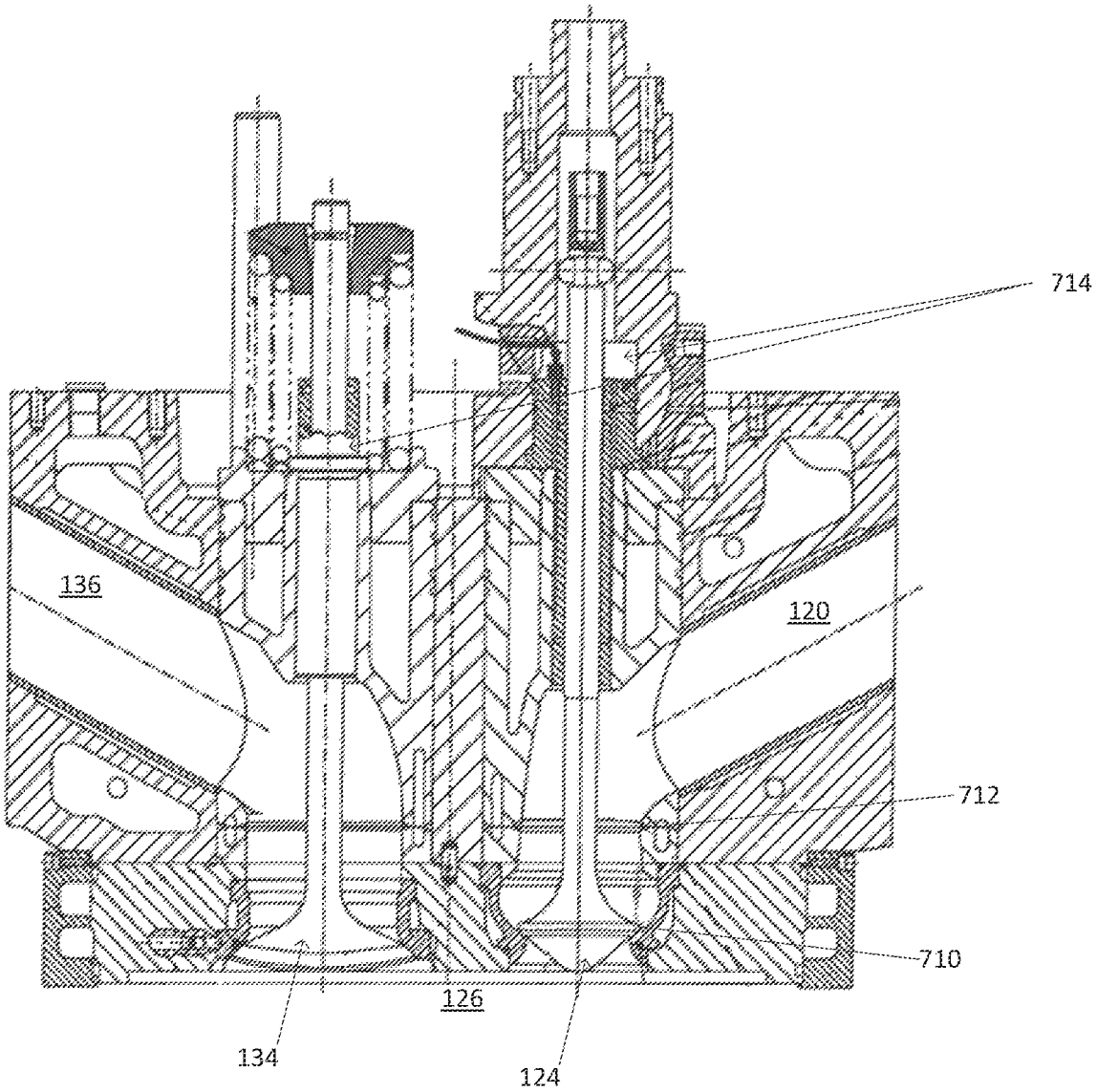
FIG. 7 shows examples of valve arrangements within the cylinder head of the combustion cylinder.

FIG. 7 shows cross-sectional view illustrating an example of combustion cylinder 126 head that may be used in the split cycle engine and including the inlet 124 and outlet 134 valves. In this diagram the inlet valve 124 opens in a direction away from the combustion cylinder 126. The inlet valve 124 is operable to move between a first closed position 710 and a second open position 712. The exhaust valve 134 is an inwardly opening valve which is operable to allow the exhaust gas out of the combustion cylinder 126, into the exhaust pathway 136 which is coupled to the recuperator 118. The valves are operated by the valve control apparatus which is connected to the controller 100 referenced in FIG. 1.

Figure 8:
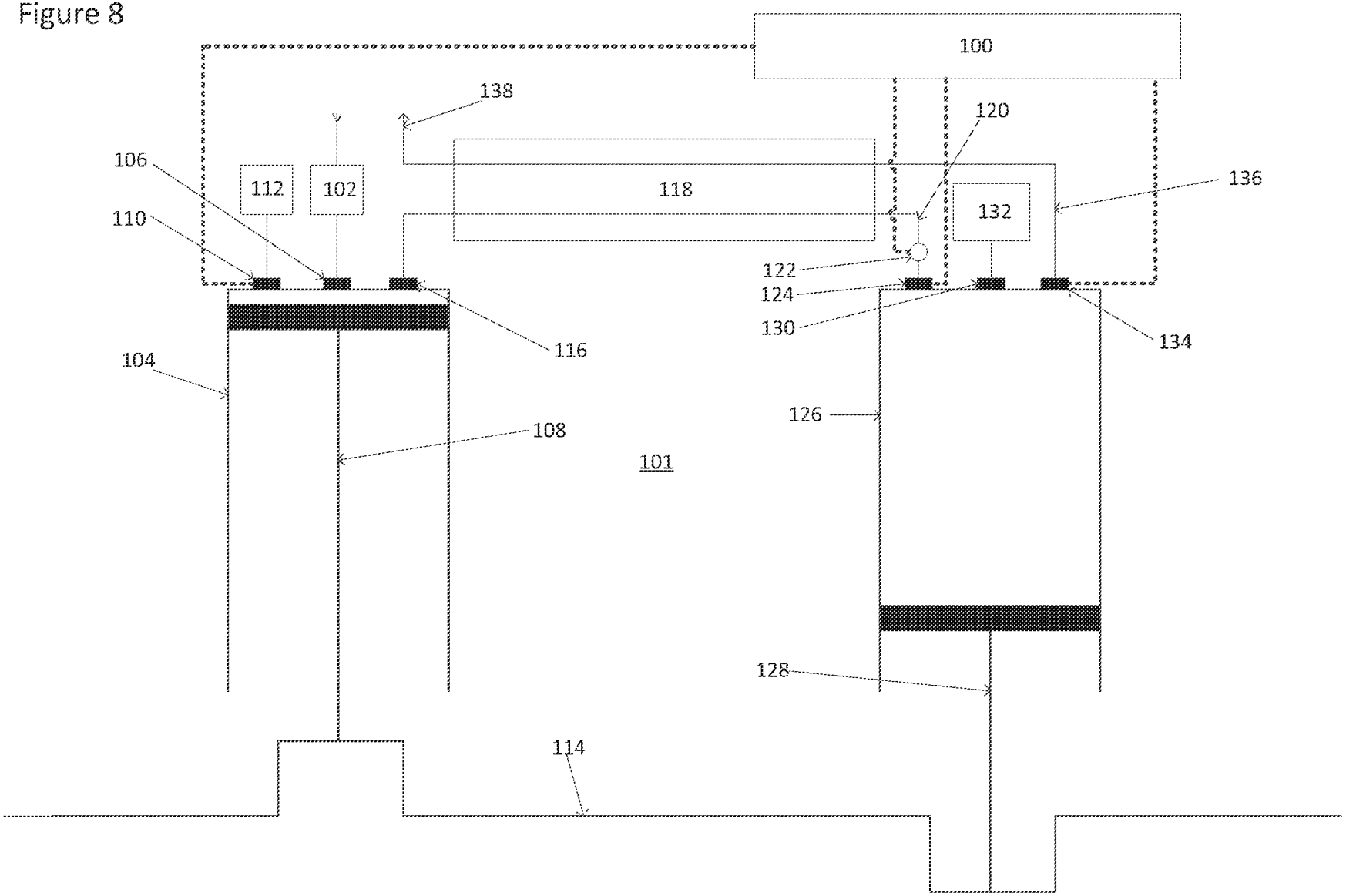
FIG. 8 shows a schematic diagram of a split cycle internal combustion engine.

FIG. 8 shows a schematic of a split cycle internal combustion engine 101. FIG. 8 is similar to FIG. 1 and with the same or similar elements having the same or similar functionality. FIG. 8 illustrates a controller 100 connected to the inlet valve 124. In the illustrated example, a temperature sensor 122 is disposed near a combustion cylinder 126 fluid intake, at a point along the path 120 of the compressed fluid between the recuperator 118 and the combustion cylinder fluid intake valve 124. This sensor 122 is operable to sense the temperature of the compressed fluid and report sensed temperature data back to the controller 100. The controller 100 is arranged to receive this temperature data and control the timing of the inlet valve 124 on the combustion cylinder 126 based at least in part on the received temperature data. It is to be appreciated in the context of this disclosure that the sensor could be placed in any suitable location to sense an indication of a parameter associated with the combustion cylinder and/or a fluid associated therewith. For example, the sensor may be placed in the recuperator or in an exhaust outlet from the combustion cylinder.

The inlet valve 124 is configured to control fluid flow in to the combustion cylinder. In operation, the controller is arranged to receive an indication of a parameter associated with the combustion cylinder and/or a fluid associated therewith. In response to receiving the indication, the controller is configured to determine whether the indicated parameter satisfies threshold criteria, for example, whether a value for the indicated parameter is equal to or greater than a target value. The controller 100 is connected to the inlet valve 124 to control the opening and closing of the inlet valve.

In this example, the cycle of the piston may be considered to start with the combustion piston 128 at its bottom dead centre position ('BDC'). In accordance with the rotation of the crankshaft 114, the combustion piston 128 moves up from BDC towards its top dead centre position ('TDC'), before proceeding back down to BDC. Accordingly, the cycle of the piston may be considered to comprise the combustion piston 128 moving from BDC to BDC via TDC. The combustion piston 128 is constrained to move along only one axis, which is the longitudinal axis of the combustion cylinder. This movement of the combustion piston 128 is in accordance with the rotation of the crankshaft 114, which rotates in a circular fashion, and so movement of the combustion piston near TDC and BDC is slower as the circular motion of the crankshaft produces only a small movement in the direction of said one axis for each degree of rotation in that region. Therefore, near TDC and BDC, the change in the volume of the cylinder enclosed by the combustion piston changes slowly, and the change in pressure in the combustion cylinder 126 per unit rotation of the crankshaft 114 (i.e. the "phase angle" or "crank angle") decreases. It is to be appreciated that the position of the combustion piston 128 in the combustion cylinder 126 may be expressed in terms of degrees of rotation of the crankshaft.

The controller 100 is configured to control the opening and closing of the inlet valve 124 dynamically so that the inlet valve 124 may be opened when the combustion piston 128 is at different positions in the combustion cylinder 126. Thus, the inlet valve 124 may be opened at different stages during the cycle of the piston. During a 'cold start' of the engine the controller 100 will be arranged to cause the inlet valve 124, e.g. to control the inlet valve 124, to open at an early opening position during the cycle of the piston. During 'normal' running conditions of the engine, when the working fluid is warm enough for sufficient combustion to occur, the controller 100 will control the inlet valve 124 to open at a late opening position. The controller 100 is configured to determine whether to operate the engine in the cold-start mode or in the normal mode based on the received indicated parameter.

The indicated parameter received by the controller 100 will be indicative of a property of the combustion cylinder and/or the fluid associated therewith. Achieving stable, rapid combustion has been problematic with split cycle internal combustion engines. In particular, during cold-start of the engine, the working fluid may be relatively cool which often results in inferior combustion, and so such engines may not be able to suitably start-up. Additionally, the presence of too much water and/or not enough oxygen may prevent suitable combustion from occurring.

To account for this, the indicated parameter received by the controller 100 may comprise one of: a temperature, a pressure, an oxygen concentration or a water concentration associated with the working fluid in the combustion cylinder 126. The target value for the parameter will correspond to the indicated parameter. The indicated parameter satisfying the target value will represent the indicated parameter indicating that the conditions in the combustion cylinder 126 are suitable for combustion. Accordingly, where the target value is a temperature, pressure or oxygen concentration, a value greater than or equal to the target parameter will indicate suitable combustion conditions. If the indicated parameter is a water concentration, a value less than the target parameter would indicate suitable combustion conditions.

Where the received indicated parameter indicates that the target value has not been satisfied, and that the conditions are not suitable for combustion, the controller 100 will control the inlet valve 124 to operate in accordance with a 'cold-start' mode of operation. In this mode, the controller 100 will control the inlet valve 124 to open at an 'early opening position' during the cycle of the piston. The early opening position will be before TDC, during the return stroke of the combustion piston 128 before said combustion piston 128 reaches its TDC position. The location of the early opening position is such that the continued movement of the combustion piston 128 will provide a substantial compression effect on the working fluid. The controller 100 is configured to open the inlet valve 124 at the early opening position in which the combustion piston 128 is at a crank angle of x° behind TDC, where, for example, the early opening position may be 5° ahead of TDC, 10° ahead of TDC, 20° ahead of TDC, 30° ahead of TDC. Opening the inlet valve 124 before TDC enables the working fluid to flow into the combustion cylinder 126 while the combustion piston 128 is still moving towards TDC. The continued movement of the combustion piston 128 provides a compression of the working fluid which will increase its temperature. Increasing the temperature of the working fluid may improve the combustion conditions in the combustion cylinder 126.

For the illustrated split cycle internal combustion engine 101 in FIG. 8, the exhaust from the combustion cylinder 126 is fed back through a recuperator 118, which is thermally coupled to the working fluid to be input into the combustion cylinder 126. Therefore, for the recuperator 118 to sufficiently warm up the fluid to be input into the combustion cylinder 126, it is desirable for the recuperator 118 to be receiving sufficiently hot exhaust fluids from the combustion cylinder 126. If this heat transfer is insufficient, for example due to insufficient combustion in the combustion cylinder 126, it may not be possible to maintain operation of the engine. Accordingly, it is important that the working fluid is warm enough to allow for suitable combustion and thus continued operation of the engine.

Providing a sufficiently warm working fluid may be achieved by the early opening of the inlet valve 124 as extra compression from the combustion piston 128 may provide the necessary heating of the working fluid. It is to be understood that there may be a trade-off between opening too early and impeding the motion of the combustion piston 128 due to the inlet of pressurised fluid, and opening early enough to achieve a sufficient warming of the working fluid. Accordingly, the controller 100 may be configured so that there is a maximum early opening position for the inlet valve 124, in which the inlet valve 124 opens z° behind TDC.

Additionally, the controller may be configured to provide dynamic monitoring and control of the inlet valve 124 by continuously monitoring the indicated parameter and varying the opening position of the inlet valve 124 based on the indicated parameter. For instance, the value of x for the early opening position in which the combustion piston 128 is x° ahead of TDC may be continuously varied based on a difference between the indicated parameter and the target value for the parameter. The controller 100 may therefore control the inlet valve 124 to open earlier in the cycle of the piston when the indicated parameter of the combustion cylinder and/or the working fluid is further away from the target value. Accordingly, when the fluid is very cool, the controller 100 will control the inlet valve 124 to open very early, for example at z°, to provide the working fluid with a larger amount of compression and thus heating.

In some embodiments, the controller 100 may be configured to open the inlet valve 124 in a continuum of positions in the cycle of the piston. In other embodiments, the controller 100 may be configured to select one of a plurality of discrete early opening positions for the inlet valve 124 for positions of the combustion piston 128 between a phase angle z° ahead of TDC and TDC, according to the difference between the indicated temperature and the target temperature. The controller 100 may perform this operation in a manner analogous to that described above for the exhaust valve.

Where the received indicated parameter indicates that the target value has been satisfied, and that there are suitable conditions for combustion, the controller 100 will control the inlet valve 124 to operate in accordance with a 'normal mode of operation'. In this mode, the inlet valve 124 will open to allow the flow of fluid into the combustion cylinder 126 at a 'late opening position' position during the cycle of the piston. The late opening position is later in the cycle of the piston than the early opening position. Typically, it will be nearer to TDC than the early opening position; it may be at TDC, or just before it.

It is desirable for all of the working fluid in the recuperator 118 to have been transferred into the combustion cylinder 126 as soon as possible after the combustion piston 128 has reached its TDC position so that the crank angle is not too great before ignition occurs. The controller 100 may control the inlet valve 124 to open at TDC or very shortly after TDC.

Alternatively, the controller 100 may control the inlet valve 124 to open slightly before the combustion piston has reached its TDC position. For example, the inlet valve 124 may be controlled to open during the return stroke of the combustion piston, before the combustion piston has reached its TDC position. For example, 1° before TDC, for example 3° before TDC, for example 5° before TDC. As the movement of the combustion piston 128 in the combustion cylinder 126 in these positions before TDC is very small with relation to the angular rotation of the crankshaft 114, there is only a negligible amount of compression performed on any working fluid in the combustion cylinder 126. Therefore, any increase in the temperature of the working fluid or of the fluid resistance to the movement of the combustion piston 128 is not a significant issue. Once all of the fluid is in the combustion cylinder 126, the controller 100 will control the inlet valve 124 to close.

Figure 9A:
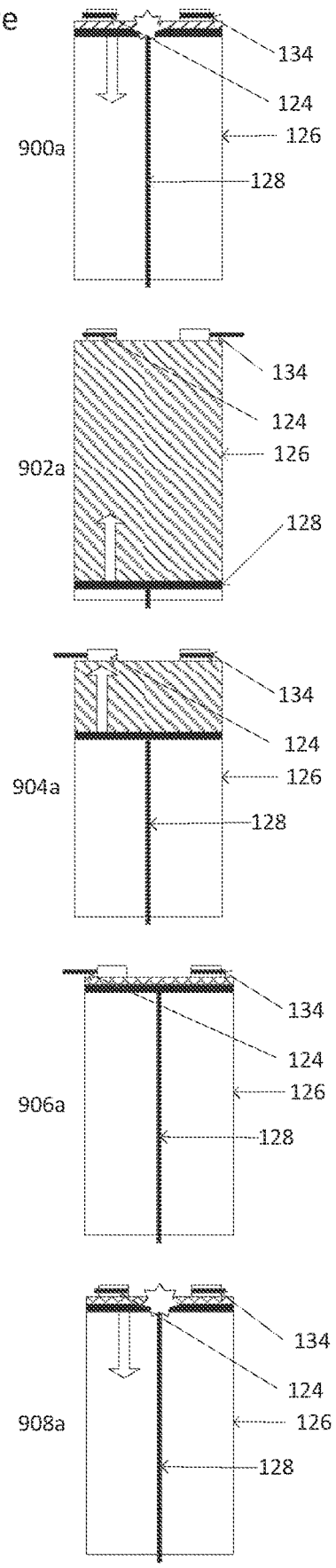
FIG. 9*a* shows stages in the operation of a combustion cylinder of the split cycle engine during a cold start mode.
Figure 9B:
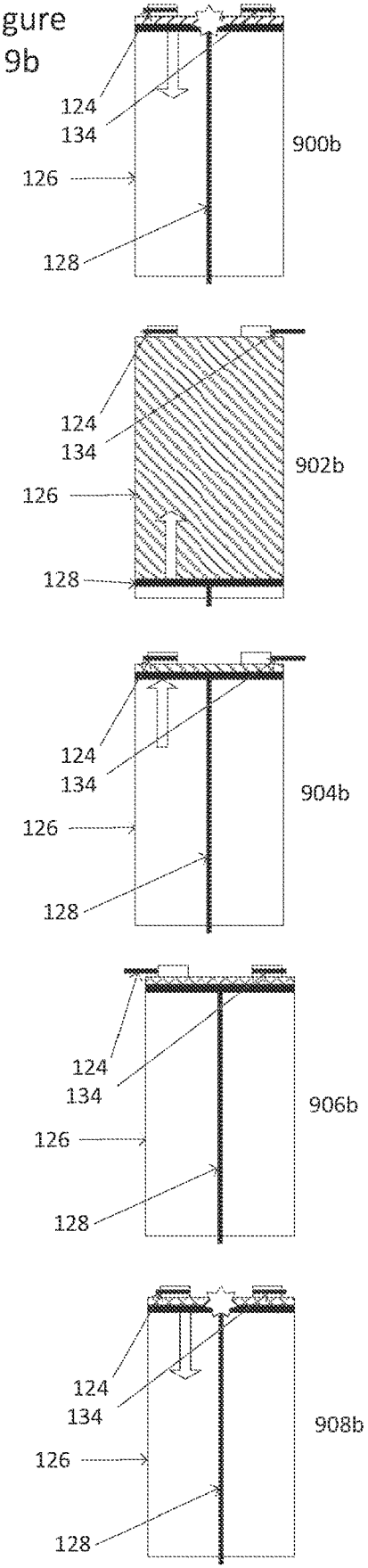
FIG. 9*b* shows stages in the operation of the combustion cylinder during a normal running mode.

A method of operation of the split cycle internal combustion engine will now be described with reference to FIGS. 9*a* and *b*. FIG. 9*a* shows schematically a process of controlling the combustion cylinder during a cold-start mode of operation, including stages 900*a*, 902*a*, 904*a*, 906*a* and 908*a* by comparison to FIG. 9*b* which shows stages 900*b*, 902*b*, 904*b*, 906*b* and 908*b* of a normal running mode. In FIGS. 9*a* and 9*b*, an indication of a parameter associated with the combustion cylinder and/or a fluid associated therewith is received, and the inlet valve 124 of the combustion cylinder 126 is controlled based on the indicated parameter. In FIG. 9*a*, the indicated parameter is less than a target value, and the inlet valve 124 is controlled to open at an early opening position. In FIG. 9*b*, the indicated parameter is equal to or greater than the target value, and the inlet valve 124 is controlled to open at a late opening position.

In FIG. 9*a*, at stage 900*a* the compressed fluid-fuel mixture ("the working fluid") is igniting as the combustion piston 128 is at, or shortly after, TDC. Depending on the type of fuel of the engine, this ignition could be initiated by a spark plug or auto-ignition. The increased pressure due to the released energy from the fuel combustion drives the combustion piston towards bottom dead centre (BDC), further driving the crankshaft 114. Once the piston reaches BDC the combusted mixture has expanded to fill the combustion cylinder 126 and the exhaust valve 134 is opened (stage 902*a*). The combustion piston then proceeds towards TDC, expelling the exhaust gases out the exhaust valve 134.

In the cold-start mode, the inlet valve 124 is opened before the combustion piston 128 reaches TDC. The inlet valve 124 is opened shortly after the exhaust valve 134 is closed. This is shown at stage 904*a*, where the inlet valve 124 is opened when the piston is about 65% of the way from BDC to TDC. This allows the compressed fluid from the compression cylinder/recuperator to flow into the combustion cylinder 126. This inlet fluid is then further compressed until the piston reaches TDC, as shown at stage 906*a*. The inlet valve 124 is closed and the injected fuel is ignited (stage 908*a*), starting the cycle over again. Providing extra heating/compression of the working fluid may lead to an increase in efficiency of the engine by offsetting the lack of heat in the engine, and in particular the recuperator 188.

This is in contrast to the normal running mode in FIG. 9*b*. In this cycle, stage 900*b*, 902*b*, 906*b* and 908*b* correspond to 900*a*, 902*a*, 906*a* and 908*a* respectively. The difference between the cold-start mode and the normal running mode is highlighted at stage 904*b*. Here, the inlet valve 124 is closed until the combustion piston reaches TDC such that no further compression of the inlet fluid may be achieved using the combustion piston 128. In this mode, the engine is running "normally" whereby little or no fluid is inlet into the compression cylinder substantially before TDC. Here, as discussed above, substantially before TDC refers to timing the inlet of fluid so that the fluid will undergo a substantial amount of compression from the combustion piston 128.

Another aspect of the disclosure will now be described with reference again to FIG. 8. In this aspect, the controller 100 is arranged to control both the inlet valve 124 and the exhaust valve 134 based on a received indication of a parameter of the combustion cylinder 128 and/or a fluid associated therewith. As described above with reference to the early opening of the inlet valve 124, the controller 100 is arranged to control the inlet valve 124 of the combustion cylinder 126 to open at an early opening position during a cycle of the piston, when a value for the received indicated parameter is less than a target value for the parameter. Additionally, as described above with reference to the early closing of the exhaust valve 134, the controller 100 is arranged to control the exhaust valve 134 of the combustion cylinder 126 to close at an early closing position during the cycle of the piston, when a value for the received indicated parameter is less than a target value for the parameter. Correspondingly, the controller may control the inlet valve 124 to open at a late opening position, in response to the received indicated parameter being equal to or greater than the target value. Likewise, the controller may control the exhaust valve 134 to close at a late closing position, in response to the received indicated parameter being equal to or greater than the target value.

The controller 100 may be configured to determine a position in the cycle of the piston for the opening and closing of each valve based at least in part on a determined opening and/or closing position for the other valve. The controller 100 is configured to ensure that the exhaust valve 134 is shut before the inlet valve 124 is opened. Otherwise, the inlet of compressed air may flow in through the inlet valve 124 and directly out the exhaust valve 134 without being used to perform any substantial work on the combustion piston 128. Likewise, during and/or after combustion as the combustion piston 128 moves to BDC, the controller 100 is configured to ensure both valves remain closed to ensure that the maximum amount of work possible is being done on the combustion piston 128. In other positions during the cycle of the piston only one of the two valves will be open. The controller 100 may determine which valve should be open, at what position and for how long based on the received indicated parameter.

The controller 100 is thus configured to control the exhaust valve 134 to close earlier in the cycle of the piston than the opening of the inlet valve 124. In response to receiving a signal indicating that the exhaust valve 134 is closed, the controller 100 may be configured to control the inlet valve 124 to open. The difference between the controller 100 controlling the exhaust valve 134 to close and the inlet valve 124 to open may be expressed either as a time lag between the two events occurring, or as a difference in the position of the cycle of the piston for the two different events occurring. For example, the exhaust valve 134 may be closed a° before TDC and the inlet valve 124 may be opened (a-b)° before TDC, where b is either a constant or a variable. The value for b may depend on the received indicated parameter. For example, b may be a constant which represents transitioning between the two states in the fastest time allowable by the setup of the engine and the control system. For example, b may be a variable which is proportional to the difference in value between the value for the indicated parameter and the target value. It may be desirable to transition between the two states in as short as time as possible.

Scientific data obtained from running tests with this valve setup suggests that the more effective way to improve the combustion conditions when the engine is cold is to open the inlet valve 124 early. The controller 100 may comprise a memory comprising data, for example in the form of a look-up table. The controller 100 may determine based on the indicated parameter how much heating of the combustion cylinder and/or the fluid associated therewith is needed to achieve selected combustion conditions. Based on this determination, the controller 100 may use the look-up table to determine a relative contribution of each approach (inlet/exhaust) to the heat generation. For instance, how much heat should be generated by compressing the exhaust fluid (e.g. from early closure of the exhaust valve 134) and how much heat should be generated by further compressing the working fluid (e.g. from early opening of the inlet valve 124). In accordance with this, the controller may control both valves to achieve a desired ratio of heat generation from the two approaches. Alternatively, the controller may favour one approach over the other, and control the valves to maximise heat generation by that means. Accordingly, the controller 100 may determine, and control the valves to achieve, heat generation from the exhaust and the inlet in a selected proportion to achieve the desired level of heating.

For example, where the desired increase in heat in the combustion cylinder 126 may be almost achievable by only closing the exhaust valve 134 early, the controller 100 may be configured to delay the time difference between the exhaust valve 134 closing and the inlet valve 124 opening so that only a small fraction of the extra heat generation comes from the compression of the inlet fluid. Accordingly, the controller 100 may dynamically control the opening of the inlet valve 124 relative to the closing of exhaust valve 134 based on the received indicated parameter.

During a normal running phase of operation of the engine, the controller 100 may be configured to control the opening/closing of the valves so that the exhaust valve is closed as late as possible before TDC. As described above, the inlet valve 124 may be opened slightly before TDC to allow all of the working fluid to be inlet into the combustion cylinder 126 to achieve the desired combustion effect. Accordingly, the controller 100 may control the exhaust valve 134 to close as soon as possible directly before it controls the inlet valve 124 to open.

Figure 10A:
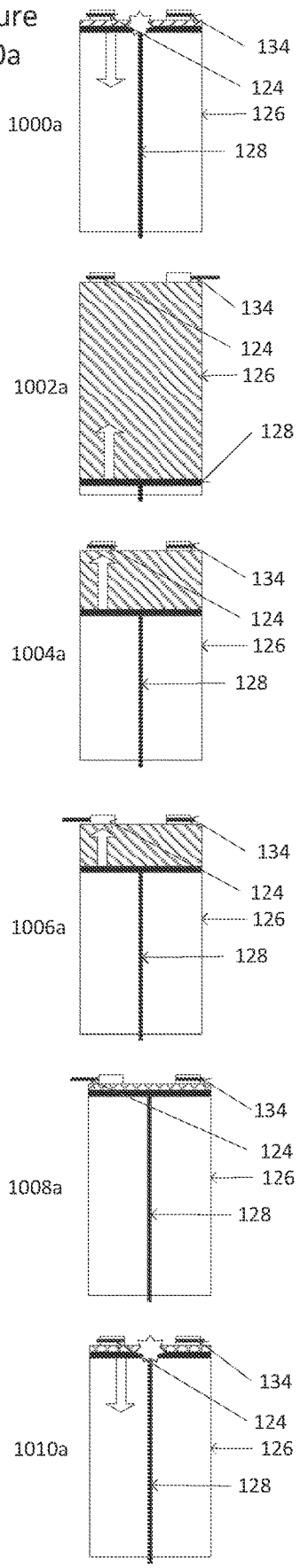
FIG. 10*a* shows stages in the operation of a combustion cylinder of the split cycle engine during a cold start mode.
Figure 10B:
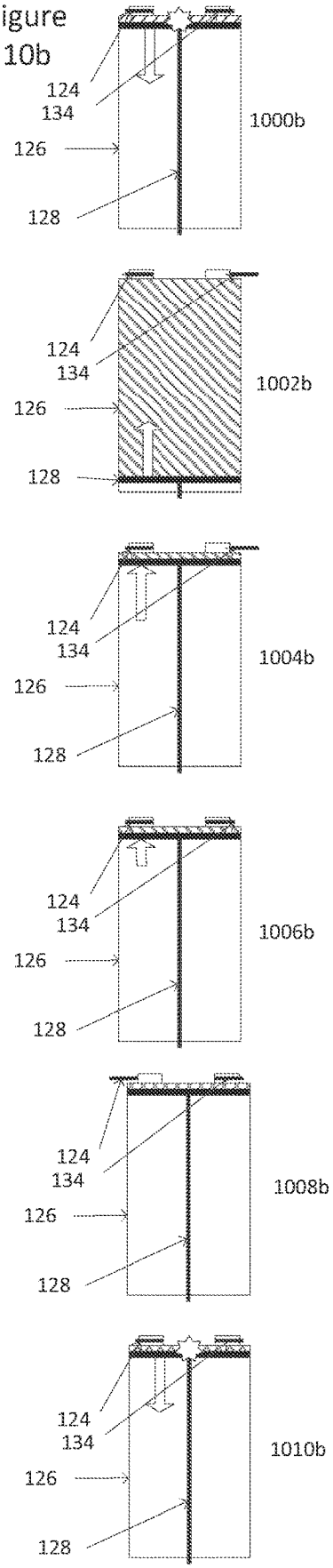
FIG. 10*b* shows stages in the operation of the combustion cylinder during a normal running mode.

A method of operation of the above aspect of the disclosure will now be described with reference to FIGS. 10*a* and *b*. FIG. 10*a* and correspond very closely to those of FIGS. 9*a* and 9*b*, and so similar steps will not be described again. Similarly, FIG. 10*a* illustrates the method of operation of the split cycle internal combustion engine during a 'cold-start', and FIG. 10*b* illustrates the method during 'normal running conditions'. In FIG. 10*a*, the method comprises receiving an indication of a parameter associated with the combustion cylinder and/or a fluid associated therewith, and determining that the indicated parameter is less than a target value for the parameter. FIG. 10*b* is included as an example for illustrative purposes of a method including determining that the indicated parameter is equal to or greater than the target value.

The main difference between the two Figures occurs at steps 1004 and 1006. At step 1004*a*, the exhaust valve 134 is controlled to close before the combustion piston 128 has reached TDC. At step 1006*a*, the inlet valve 124 is controlled to open before the combustion piston 128 has reached TDC, but after the exhaust valve 134 has shut. In contrast, at step 1004*b*, the exhaust valve 134 remains open, and is only closed at step 1006*b*, where the combustion piston 128*b* is there or thereabouts at TDC. The inlet valve 124 is then opened at step 1008*b* where the combustion piston 128 is at TDC.

Figure 11:
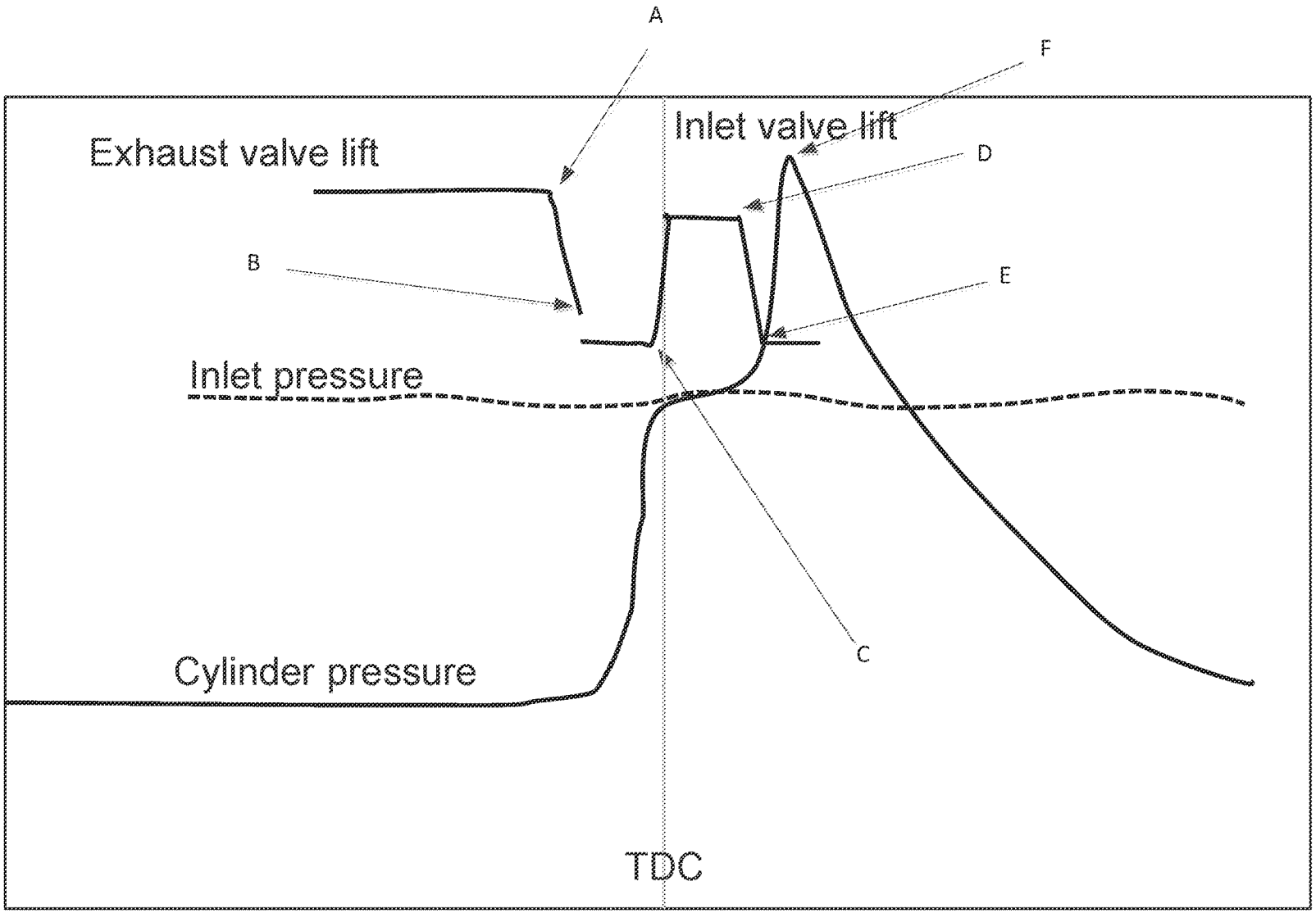
FIG. 11 shows an ideal pressure trace for optimal operation of the split cycle internal combustion engine during a normal running mode.

FIG. 11 shows an example pressure trace for optimal operation of the split cycle internal combustion engine during a normal running mode. Moving from left to right, during the return leg of the combustion piston 128, the cylinder pressure remains fairly constant as the combustion piston 128 moves towards TDC from BDC with the exhaust valve 134 open and the inlet valve 124 closed. At point A, the exhaust valve 134 begins to close, and at point B it is fully closed. In response to the closing of the exhaust valve 134, the cylinder pressure begins to rise. At point C, which is slightly before TDC, the inlet valve 124 begins to open so that it is fully open at TDC. The inlet valve 124 remains fully open until point D, which is shortly after TDC where it begins to close. At point E, the inlet valve 124 is fully closed. During the opening and closing of the inlet valve, the cylinder pressure steadily increases until the combustion begins, at which point the cylinder pressure rapidly increases to a maximum at point F. After point F, the cylinder pressure steadily decreases as the combustion piston 128 moves from TDC towards BDC.

Figure 12:
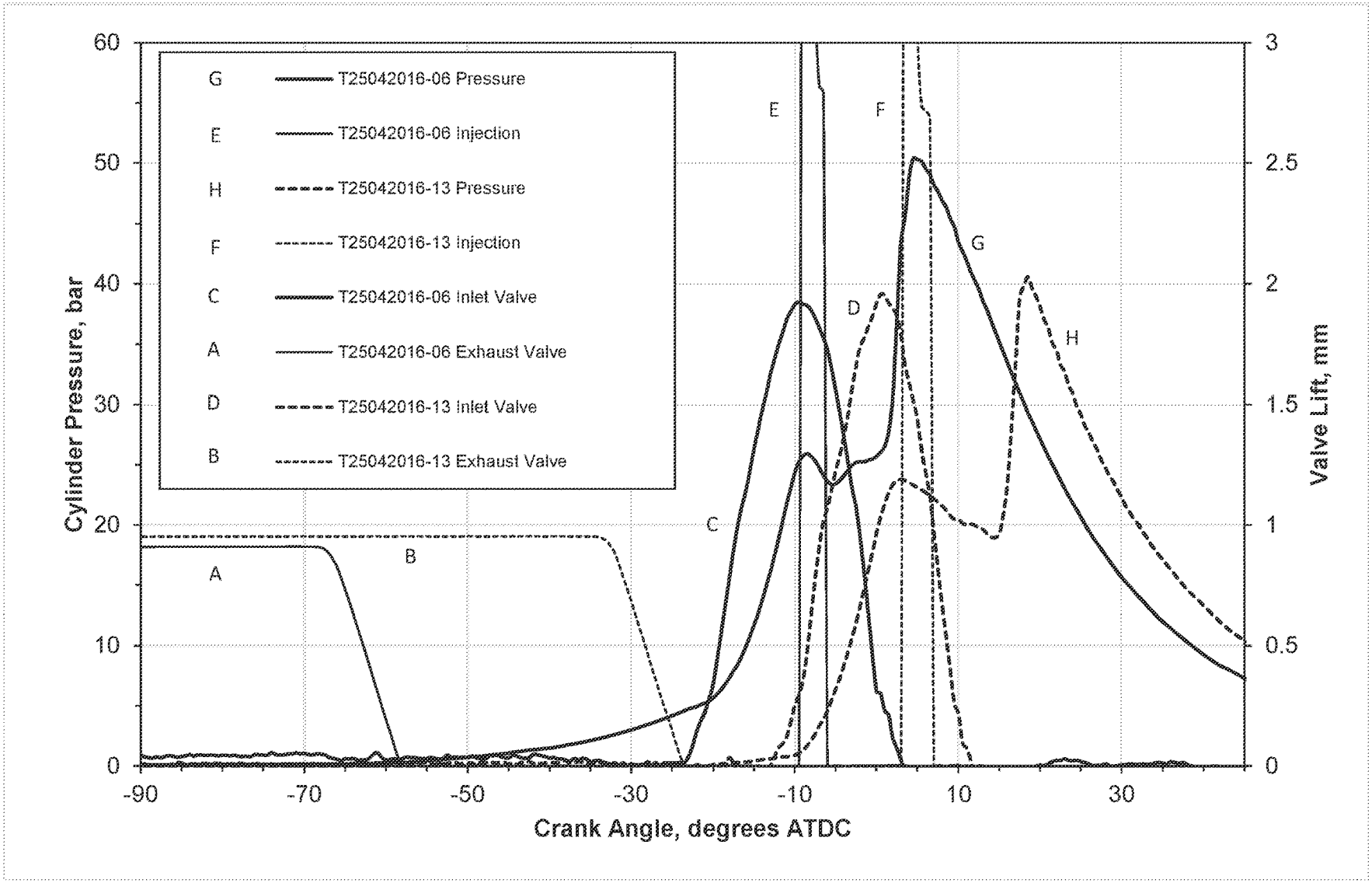
FIG. 12 shows a graph illustrating results from varying the timing of the opening of the inlet valve and the closing of the exhaust valve.

FIG. 12 shows a graph illustrating results from varying the timing of the opening of the inlet valve and the closing of the exhaust valve. The results illustrated in FIG. 12 were obtained based on the engine running at 800 rpm. The solid lines represent the early opening of the inlet valve and the early closing of the exhaust valve, and the dashed lines represent the late opening and late closing.

Lines A and B represent opening/closing of the exhaust valve. Line A shows the exhaust valve being opened early at approximately 65° before TDC, whereas line B shows the exhaust valve being opened late at 35° before TDC. In both cases, the graph shows that it takes around 5 to 10° of rotation for the exhaust valve to move from fully opened to fully closed. In both cases, the effect of closing the exhaust valve early results in a corresponding increase in the cylinder pressure illustrated by lines G and H respectively. Lines C and D represent opening/closing of the inlet valve. For line C the inlet valve begins opening at around 23° before TDC, whereas line D the inlet valve begins opening at around 13° before TDC. In both cases, it takes around 13° to reach the fully open state, at which point the valve begins to close again, which takes around 13° to fully close. Lines E and F represent injection of the fuel into the cylinder. In both cases the injection is short and sharp, progressing from zero to its peak level within around 2° before returning back to zero, again within about 2°. Line E represents the injection starting at around 10° before TDC, whereas line F represents the injection starting at around 3° after TDC.

The effect of the two timings is illustrated by lines G and H respectively, which represent the cylinder pressure. As can be seen, line G, which corresponds to the early closing of the exhaust valve and the early opening of the inlet valve, reaches a substantially higher peak (and thus higher temperature) of around 51 bar compared to the delayed and smaller peak (41 bar) of line H. Accordingly, this graph illustrates the benefits associated with the early opening of the inlet valve and the early closure of the exhaust valve.

Figure 13:
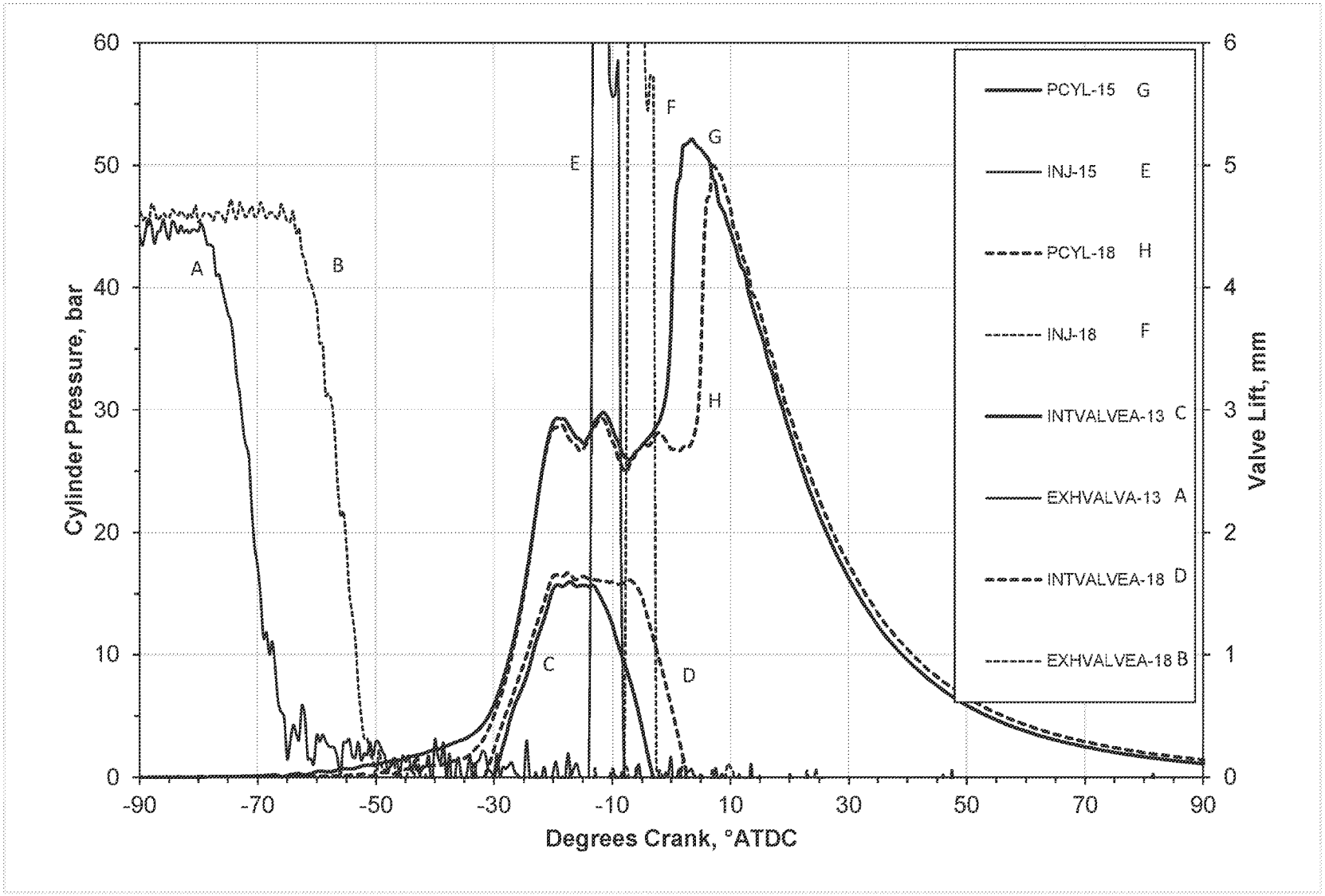
FIG. 13 shows a graph illustrating results from varying the timing of the opening of the inlet valve and the closing of the exhaust valve.

FIG. 13 shows a graph illustrating results from varying the timing of the opening of the inlet valve and the closing of the exhaust valve. The results illustrated in FIG. 13 were obtained based on the engine running at 1200 rpm. Again, the solid lines represent the early opening of the inlet valve and the early closing of the exhaust valve, and the dashed lines represent the late opening and late closing.

The lines of FIG. 13 and their reference letters correspond to those described above in relation to FIG. 12 and so will not be repeated. Line A of FIG. 13 shows the exhaust valve closing early, at around 75° before TDC, and line B shows the exhaust valve closing at around 60° before TDC. Both valve closures result in a slight increase in the cylinder pressure (lines G and H respectively). At around 30° before TDC, both lines C and D show the inlet valve being opened, with line D opening slightly beforehand. Line D also remains opening for longer, with the inlet valve being fully closed at around 3° after TDC, compared to the inlet valve being fully closed around 3° before TDC for line C. Line E shows the injection commencing at around 14° before TDC, whereas line F shows the injection commencing at around 8° before TDC.

As with FIG. 12, the lines G and H represent the cylinder pressure, and it is evident that line G reaches a higher pressure (around 53 bar and thereby represents a higher temperature) than line H (around 50 bar). Additionally, the peak of line G arrives about 5° before that of line H, with line G peaking just after TDC. Accordingly, this graph illustrates the benefits of an earlier timing system for the engine.

It is envisaged that control of any of the cryogen input, exhaust valve timings and recuperator water injection could be implemented individually or in combination, to improve the efficiently of split cycle engines.

In examples, the split cycle engine need not employ cryogen injection in the compression cylinder.

In examples, the split cycle engine could use petrol, diesel or another fuel.

In some examples, one or more memory elements can store data and/or program instructions used to implement the operations described herein. Embodiments of the disclosure provide tangible, non-transitory storage media comprising program instructions operable to program a processor to perform any one or more of the methods described and/or claimed herein and/or to provide data processing apparatus as described and/or claimed herein.

The activities and apparatus outlined herein may be implemented with fixed logic such as assemblies of logic gates or programmable logic such as software and/or computer program instructions executed by a processor. Other kinds of programmable logic include programmable processors, programmable digital logic (e.g., a field programmable gate array (FPGA), an erasable programmable read only memory (EPROM), an electrically erasable programmable read only memory (EEPROM)), an application specific integrated circuit, ASIC, or any other kind of digital logic, software, code, electronic instructions, flash memory, optical disks, CD-ROMs, DVD ROMs, magnetic or optical cards, other types of machine-readable mediums suitable for storing electronic instructions, or any suitable combination thereof.

It will be appreciated from the discussion above that the embodiments shown in the Figures are merely exemplary, and include features which may be generalised, removed or replaced as described herein and as set out in the claims. In the context of the present disclosure other examples and variations of the apparatus and methods described herein will be apparent to a person of skill in the art.

What is claimed is:

1. A split cycle internal combustion engine, comprising:

a combustion cylinder accommodating a combustion piston;

a compression cylinder accommodating a compression piston and being arranged to provide compressed fluid to the combustion cylinder, wherein the compression cylinder is arranged to receive a liquid which has been condensed into its liquid phase via a refrigeration process, such that the liquid vaporises into its gaseous phase during a compression stroke of the compression piston, such that a rise in temperature caused by the compression stroke is limited by absorption of heat by the liquid; and a controller arranged to receive an indication of a parameter associated with the combustion cylinder and/or a fluid associated therewith and to control an amount of the liquid provided to the compression cylinder in dependence on the indicated parameter so that:

a "normal mode" quantity of the liquid is provided to the compression cylinder when the indicated parameter is equal to or greater than a target value for the parameter; and a "cold mode" quantity of the liquid is provided to the compression cylinder when the indicated parameter is less than a target value for the parameter, wherein the "cold mode" quantity is less than the "normal mode" quantity.

2. The split cycle engine of claim 1, wherein the liquid comprises at least one of liquid nitrogen, argon and neon.

3. The split cycle engine of claim 1, wherein the controller is arranged to receive an indication of a pressure associated with the engine or a fluid therein and to control the amount of the liquid provided to the compression cylinder in dependence on the indicated pressure.

4. The split cycle engine of claim 1, wherein the controller is arranged to receive an indication of an oxygen concentration associated with the engine or a fluid therein and to control the amount of the liquid provided to the compression cylinder in dependence on the indicated oxygen concentration.

5. The split cycle engine of claim 1, further comprising a recuperator arranged to thermally couple the compressed fluid to an exhaust product of the combustion cylinder to heat the compressed fluid provided to the combustion cylinder.

6. The split cycle engine of claim 5, wherein a catalytic coating is provided on a surface of the recuperator which is, in use, in contact with the exhaust product.

7. The split cycle engine of claim 6, wherein the catalytic coating is provided so as to be, in use, in thermal communication with the compressed fluid and the exhaust product in order to be heated by both the compressed fluid and the exhaust product to accelerate light-off of a catalyst in the catalytic coating.

8. The split cycle engine of claim 5, wherein, for indicated temperatures in excess of a threshold temperature which is greater than a target temperature, the controller is arranged to control injection of water into the recuperator.

9. The split cycle engine of claim 1, wherein the controller has memory which defines a hot mode of operation for indicated temperatures in excess of a threshold temperature which is greater than a target temperature, wherein the controller is arranged in the hot mode to:

control at least one of a rate and quantity of the liquid provided to the compression cylinder in dependence on the indicated temperature.

10. The split cycle engine of claim 5, wherein an indication of a temperature associated with the combustion cylinder is provided by a sensor which is arranged to sense at least one of: a temperature at a compression cylinder outlet, a temperature at a combustion cylinder inlet, a temperature at a combustion cylinder outlet, and a temperature at the recuperator.

11. The split cycle engine of claim 6, wherein the indication of the temperature of the combustion cylinder is provided by a sensor which is arranged to sense a temperature at a location of a catalyst in the catalytic coating.

12. The split cycle engine of claim 1, wherein an inlet valve of the combustion cylinder is arranged to open into the combustion cylinder to allow the compressed fluid into the combustion cylinder.

13. The split cycle engine of claim 1, wherein an inlet valve of the combustion cylinder is arranged to open outward from the combustion cylinder to allow the compressed fluid into the combustion cylinder.

14. The split cycle engine of claim 1, wherein the compression cylinder is thermally insulated with one or more layers each comprising steel or ceramic.

15. The split cycle engine of claim 1, wherein the combustion cylinder is thermally insulated with one or more layers each comprising steel or ceramic.

16. A split cycle internal combustion engine, comprising:

a combustion cylinder accommodating a combustion piston;

a compression cylinder accommodating a compression piston and being arranged to provide compressed fluid to the combustion cylinder, wherein the compression cylinder is arranged to receive a liquid which has been condensed into its liquid phase via a refrigeration process, such that the liquid vaporises into its gaseous phase during a compression stroke of the compression piston, such that a rise in temperature caused by the compression stroke is limited by absorption of heat by the liquid; and a controller arranged to receive an indication of a temperature associated with the combustion cylinder and/or a fluid associated therewith and to control an amount of the liquid provided to the compression cylinder in dependence on the indicated temperature so that:

a "normal mode" quantity of liquid is provided to the compression cylinder when the indicated temperature is equal to or greater than a target temperature; and a "cold mode" quantity of liquid is provided to the compression cylinder when the indicated temperature is less than a target temperature, wherein the "cold mode" quantity is less than the "normal mode" quantity.

17. A method of operating a split cycle internal combustion engine, the engine comprising:

a combustion cylinder accommodating a combustion piston; and a compression cylinder accommodating a compression piston and being arranged to provide compressed fluid to the combustion cylinder, wherein the compression cylinder is arranged to receive a liquid which has been condensed into its liquid phase via a refrigeration process, such that the liquid vaporises into its gaseous phase during a compression stroke of the compression piston, such that a rise in temperature caused by the compression stroke is limited by absorption of heat by the liquid;

the method comprising:

receiving an indication of a parameter associated with the combustion cylinder and/or a fluid associated therewith; and controlling an amount of liquid provided to the compression cylinder in dependence on the indicated parameter so that:

a "normal mode" quantity of the liquid is provided to the compression cylinder when the indicated parameter is equal to or greater than a target value for the parameter; and a "cold mode" quantity of the liquid is provided to the compression cylinder when the indicated parameter is less than a target value for the parameter, wherein the "cold mode" quantity is less than the "normal mode" quantity.

18. The method of claim 17, wherein the indication of a parameter is an indication of a temperature associated with the combustion cylinder and/or a fluid associated therewith, and the target value for the parameter is a target temperature.

19. The method of claim 17, wherein the indication of a parameter is an indication of a pressure associated with the combustion cylinder and/or a fluid associated therewith, and the target value for the parameter is a target pressure.

20. The method of claim 17, wherein the indication of a parameter is an indication of an oxygen concentration of a fluid associated with the combustion cylinder, and the target value for the parameter is a target oxygen concentration.

* * * * *